US010422149B1

(12) United States Patent
Krombein

(10) Patent No.: US 10,422,149 B1
(45) Date of Patent: Sep. 24, 2019

(54) WATERJET APPARATUS WITH PLASTER ATTACHMENT DEVICE FOR CLEANING ARTIFICIAL BODIES OF WATER

(71) Applicant: Todd Krombein, Phoenix, AZ (US)

(72) Inventor: Todd Krombein, Phoenix, AZ (US)

( * ) Notice: Subject to any disclaimer, the term of this patent is extended or adjusted under 35 U.S.C. 154(b) by 208 days.

(21) Appl. No.: 14/848,193

(22) Filed: Sep. 8, 2015

Related U.S. Application Data

(60) Provisional application No. 62/046,829, filed on Sep. 5, 2014.

(51) Int. Cl.
*E04H 4/16* (2006.01)

(52) U.S. Cl.
CPC ..... *E04H 4/169* (2013.01)

(58) Field of Classification Search
CPC ..... E04H 4/169
See application file for complete search history.

(56) References Cited

U.S. PATENT DOCUMENTS

| | | | | |
|---|---|---|---|---|
| 6,340,035 | B2 | 1/2002 | Wright | |
| 6,643,857 | B1 | 11/2003 | Kenna et al. | |
| 6,971,588 | B1 | 12/2005 | Tarr et al. | |
| 8,308,081 | B1 | 11/2012 | Goettl | |
| 2002/0117225 | A1* | 8/2002 | Wright | E04H 4/1236 138/96 R |

OTHER PUBLICATIONS

In-Floor Cleaning & Circulation, PCC 2000, Paramount, Chandler, Arizona, USA, http://1paramount.com/products/aapdf/PCC2000Brochure.pdf, document available on or before Mar. 9, 2009 (per Internet Archive Wayback Machine, http://web.archive.org/web/20090309014554/http://1paramount.com/products/pcc/ linking to http://web.archive.org/web/20160128003601/http://www.1paramount.com/products/aapdf/PCC2000Brochure.pdf), Accessed on Nov. 7, 2016, 12 pages.

Total Circulation—efficiency in energy and hydraulics, Product Catalog by A&A Manufacturing, Sep. 16, 2015, 60 pages, A&A Manufacturing, Phoenix, Arizona, USA.

Photographs of a Polaris Caretaker Pop-Up Cleaning Head, in 5 pages, sold prior to Apr. 20, 2015.

U.S. Appl. No. 15/890,145, filed Feb. 6, 2018, Krombein.

* cited by examiner

*Primary Examiner* — Spencer E Bell
(74) *Attorney, Agent, or Firm* — Knobbe Martens Olson & Bear LLP

(57) ABSTRACT

A waterjet apparatus can be installed a wall for containing an artificial body of water, such as a pool bottom and/or sidewalls. The waterjet apparatus can be used with an intermittently operated water delivery system to clean pool bottom and/or sidewalls. The waterjet apparatus has a plaster attachment device for securing a plaster mixture to the waterjet apparatus The plaster attachment device can protrude from or be substantially flush with the pool bottom and/or sidewalls.

20 Claims, 36 Drawing Sheets

WATERJET APPARATUS WITH PLASTER ATTACHMENT DEVICE FOR CLEANING ARTIFICIAL BODIES OF WATER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The present disclosure generally relates to waterjet apparatus for cleaning artificial bodies of water, and in particular, waterjet apparatus for cleaning a pool, spa, or the like.

Description of the Related Art

Artificial bodies of water, such as pools, spas, fountains, ornamental ponds, utility ponds and the like, typically have filter systems that allow the water in the body of water to be filtered and cleaned. Typically, the water is removed from the artificial body of water via a drain and is pumped through a filtration or cleaning system. It is preferable that the water flows through the system as efficiently as possible. Waterjet delivery devices such as cleaning heads are often used as part of an in-floor pool cleaning system to circulate jets of water near the floor and sidewalls of a pool.

These in-floor cleaning heads are usually made of plastic, mounted flush with the adjoining surface of the pool and intermittently supplied with pressurized water to activate them. When the cleaning heads are activated, they usually extend beyond the surface of the pool to direct a jet of water from a nozzle across the adjacent surface to dislodge debris from the pool surface and place it in suspension for subsequent removal by the pool filter.

This Background is provided to introduce a brief context for the Summary and Detailed Description that follow. This Background is not intended to be viewed as limiting the claimed subject matter to implementations that solve any or all of the disadvantages or problems presented herein.

SUMMARY

A waterjet apparatus according to an embodiment of the present disclosure for in-floor swimming pool and spa cleaning systems is provided. The apparatus comprises a cylindrical sleeve; a spring biased hollow stem positioned inside the cylindrical sleeve; a nozzle head member having an annular upper surface and circumferential sidewall extending upwardly from the annular upper surface, wherein the nozzle head member further comprising an annular step extending upwardly from the annular upper surface of the nozzle head member between the sidewall and the upper surface of the nozzle head member; a plurality of fastening points formed on the upper surface of the nozzle head; and a recessed plate having a top surface and a plurality of snap-on fastening members, wherein the snap-on fastening members engage with the fastening points formed on the upper surface of the nozzle head member in manner such that the top surface of the recessed plate is substantially flush with the annular step of the nozzle head member so as to form a substantially flat recessed support surface surrounded by the sidewall of the nozzle head member.

A waterjet apparatus according to an embodiment of the present disclosure for cleaning an artificial body of water is provided. The apparatus comprises a housing having a housing periphery about a central axis of the housing wherein the housing periphery defining an outermost boundary of the housing; a head movably connected to the housing, the head configured to reciprocate correspondingly with an intermittent delivery of pressurized water and configured to direct the pressurized water along a desired direction to clean the artificial body of water, wherein the head rotates about the central axis of the housing after delivery of pressurized water; and a plaster attachment device connected to the head, the plaster attachment device comprising a plaster device periphery about the central axis, the plaster device periphery substantially aligned with the housing periphery along the central axis, and the plaster attachment device comprising a plaster opening and a sidewall, the plaster opening configured to receive and support plaster mixtures substantially matching plaster mixtures of a wall configured to contain the artificial body of water, the plaster opening configured to support plaster at a desired depth, the sidewall configured to support plaster at a desired radius.

A waterjet apparatus according to an embodiment of the present disclosure for cleaning an artificial body of water is provided. The apparatus comprises a body having a nozzle opening, the nozzle opening configured to direct pressurized water along a desired direction to clean the artificial body of water; and a plaster attachment device connected to the body, the plaster attachment device comprising a plaster cavity configured to retain plaster, the plaster attachment device comprising a central opening in fluid communication with the nozzle opening; and a recessed cover configured to be positioned on the central opening, the recessed cover configured to be engaged with the plaster device to inhibit movement of the recessed cover into the central opening and laterally relative to the central opening, the recessed cover configured to support plaster and inhibit fluid communication between the plaster cavity and the nozzle opening.

A waterjet apparatus for in-floor swimming pool cleaning systems according to an embodiment of the present disclosure is provided. The waterjet apparatus comprises a plaster attachment device for securing and confining plaster, such as a plaster mixture, to a predetermined area on the waterjet apparatus. The apparatus can include a plaster opening having a plaster securing upper surface with sidewalls to contain a plaster mixture which may include material or structure formed from a loosely compacted mass of fragments or particles such as pebbles. The apparatus can have other structures such as flanges, protrusions, bosses, grooves, indentations, and/or the like to facilitate securing the plaster in the plaster opening. The plaster attachment device can include slots for mating with maintenance tools where, for example, surface finish area is maximized relative to the dimension (e.g., diameter) of the waterjet apparatus.

The plaster attached to the waterjet apparatus can vary to match the wall and floor of the pool. In some embodiments, the waterjet apparatus comprises a top having an upper surface and a side surface wherein the side surface includes at least one opening permitting fluid communication therethrough between internal mechanisms of the waterjet apparatus and artificial body of water. A section of the upper surface is recessed so as to define a cavity region wherein the cavity region is configured to retain plaster so as to provide the upper surface of the waterjet apparatus with a plaster finish.

In some embodiments, the cavity is approximately between ⅛ inches to 1 inch deep and extends from the center of the upper surface to the outer perimeter of the upper surface. The cavity region can be defined by a sidewall that extends outward from the plane of the upper surface. In some embodiments, the sidewall extends outward from the plane of the upper surface and simultaneously extends inward toward the center of the upper surface to facilitate retention of the plaster finish. In some embodiments, the waterjet apparatus is formed of a clear material so that it is camouflaged by the plaster. The waterjet apparatus can be circular in shape like most conventional cleaning heads; however, the waterjet apparatus can take on a variety of other shapes.

A waterjet apparatus for cleaning an artificial body of water according to an embodiment of the present disclosure includes one or more of the following: a housing comprising a plurality of housing slots positioned along a periphery of the housing; a head movably connected to the housing, the head configured to reciprocate correspondingly with an intermittent delivery of pressurized water and configured to direct the pressurized water along a desired direction, wherein the head rotates about a central axis of the waterjet apparatus after delivery of pressurized water; and a plaster attachment device connected to the head, the plaster attachment device configured to receive plaster substantially matching plaster of a wall for pools and spas, and comprising a plaster device slot, the plaster attachment device slot aligning with a first housing slot of the plurality of housing slots when pressurized water is not being delivered.

In some embodiments, the waterjet apparatus can further include one or more of the following: after delivery of pressurized water and rotation of the head, the plaster attachment device rotates with the head such that the plaster attachment device slot aligns with a second housing slot of the plurality of housing slots; after a predetermined number of rotations of the head and the plaster attachment device, the plaster attachment device slot aligns with the first housing slot after aligning with each housing slot of the plurality of housing slots; the plurality of housing slots comprises 10 to 14 housing slots positioned about the periphery of the housing; the plaster attachment device comprises another plaster device slot aligning with a second housing slot of the plurality of housing slots when pressurized water is not being delivered; the other plaster device slot is positioned opposite the plaster attachment device slot relative to the central axis; the plaster attachment device slot is configured to allow a tool to pass through the plaster attachment device slot into the first housing slot to allow the tool to engage the first housing slot to rotate the housing about the central axis; a periphery of the plaster attachment device substantially corresponds to the periphery of the housing, the plaster attachment device slot positioned along the periphery of the plaster attachment device; the plaster attachment device comprises an opening configured to house the plaster; the opening has a depth along the central axis of about ⅛ inches to about 1 inch; and/or the plaster device comprises a flange extending into the opening, the flange configured to retain the plaster in the opening.

A waterjet head for cleaning an artificial body of water according to an embodiment of the present disclosure includes one or more of the following: a body comprising a nozzle opening configured to direct pressurized water along a desired direction to clean the artificial body of water, wherein the body rotates about a central axis of the body after delivery of the pressurized water; and/or a plaster attachment device connected to the body, the plaster attachment device configured to receive plaster substantially similar to plaster of a surface configured to contain the artificial body of water, the plaster attachment device comprising a slit positioned proximate to a perimeter of the plaster attachment device.

In some embodiments, the waterjet head can further include one or more of the following: the plaster attachment device comprises another slit positioned proximate to the perimeter of the plaster attachment device and opposite the slit relative to the central axis; the slit comprises an indentation in a wall surface of the plaster attachment device, the wall surface extending along the perimeter of the plaster attachment device about the central axis to form an outermost boundary of the plaster attachment device; the indentation is substantially rectangular; the slit is configured to engage a tool configured to rotate the plaster attachment device about the central axis; the plaster attachment device comprises a plaster opening configured to support the plaster of the plaster attachment device; the plaster opening has a depth along the axis of about ⅛ inches to about 1 inch; the plaster opening comprises a bottom and a sidewall configured to retain the plaster of the plaster attachment device in a desired portion relative to the plaster attachment device; the bottom extends radially outward relative to the central axis, and wherein the sidewall extends along the central axis and substantially perpendicular to the bottom; the plaster attachment device comprises a flange extending into the plaster opening toward the central axis, the flange configured to retain the plaster of the plaster attachment device in the plaster opening; and/or the plaster attachment device extends radially outward from the body relative to the central axis.

According an embodiment of this disclosure, a waterjet head for cleaning an artificial body of water includes one or more of the following: a body comprising a nozzle opening and a central opening, the nozzle opening configured to direct pressurized water along a desired direction to clean the artificial body of water; a plaster attachment device connected to the body, the plaster attachment device configured to support a plaster opening configured to support plaster substantially resembling plaster of a surface configured to contain the artificial body of water; and/or a recessed base over the central opening, the recessed base engaged with the body to inhibit movement of the recessed base into the central opening and laterally relative to the central opening, the recessed base configured to support the plaster.

In some embodiments, the waterjet head can further include one or more of the following: the body comprises a slot, and the recessed base comprises a projection mating with the slot to engage the recessed base to the body; upon disengagement of the projection from the slot, the recessed base is movable away from the plaster device along a central axis of the body; the body further comprises a lip, the recessed base configured to rest on the lip to help inhibit lateral movement of the recessed base relative to the central opening; the cover comprises a periphery corresponding to a perimeter of the lip, wherein the perimeter of the lip engages the periphery of the lip to inhibit lateral movement of the recessed base perpendicular to a central axis of the body; at least part of the recessed base rests on top of the lip to inhibit movement of the recessed base into the central opening along a central axis of the body and the recessed base; the plaster attachment device comprises a plaster opening configured to house the plaster; the plaster attachment device opening has a depth of about ⅛ inches to about 1 inch; the plaster opening comprises a bottom and a sidewall configured to retain the plaster relative to the plaster attachment device; the bottom extends radially outward, and wherein the sidewall extends substantially perpendicular to the bottom; the plaster attachment device comprises a flange extending into the plaster opening, the flange configured to retain the plaster of the plaster attachment device in the plaster opening; and/or the plaster attachment device extends radially outward from the body.

The foregoing is a summary and contains simplifications, generalization, and omissions of detail. Those skilled in the art will appreciate that the summary is illustrative only and is not intended to be in any way limiting. Other aspects, features, and advantages of the devices and/or processes and/or other subject matter described herein will become apparent in the teachings set forth herein. The summary is provided to introduce a selection of concepts in a simplified form that are further described below in the Detailed Description. This summary is not intended to identify key features or essential features of any subject matter described herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1A:
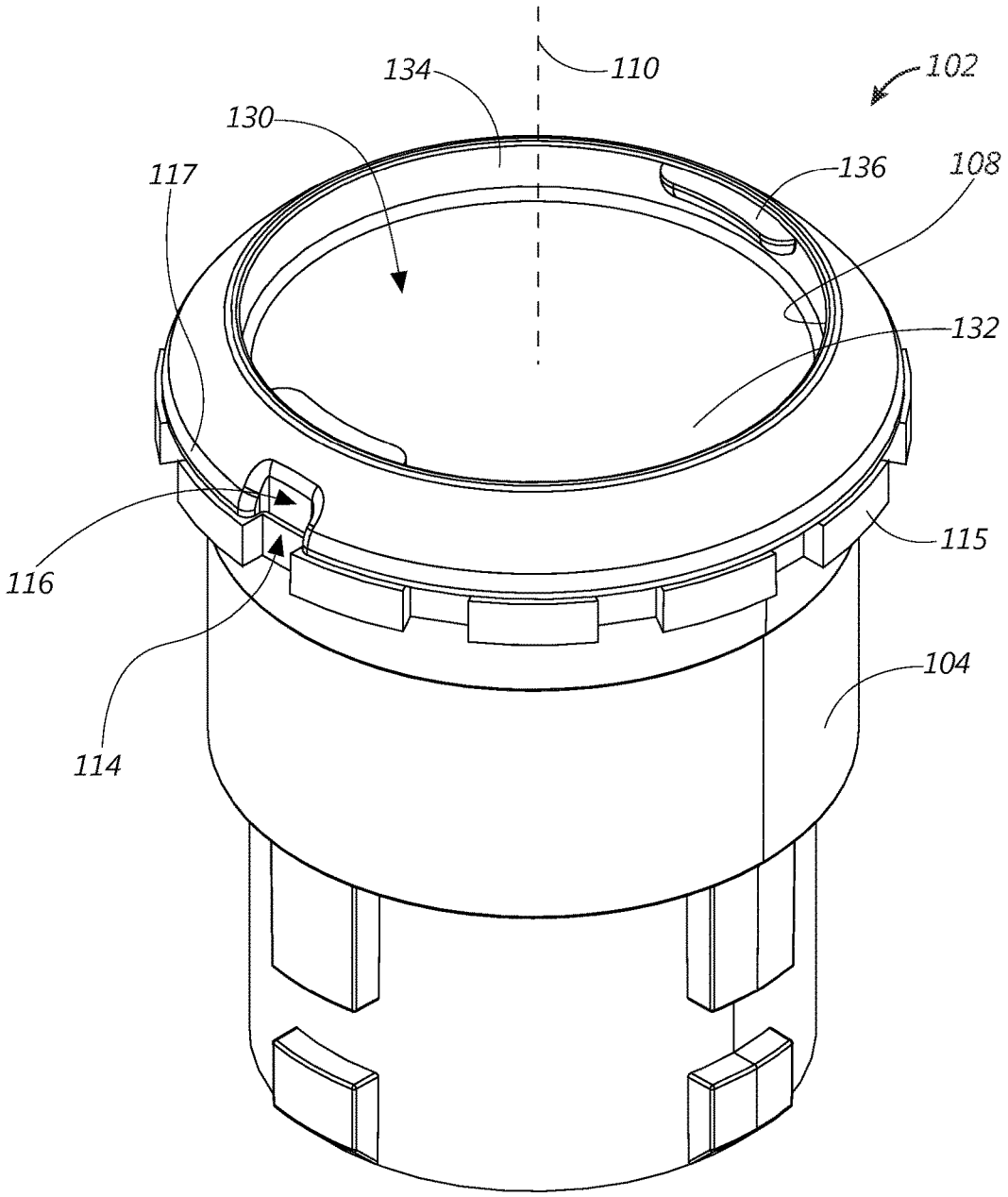
FIG. 1A illustrates a top isometric view of an embodiment of a waterjet apparatus.
Figure 1B:
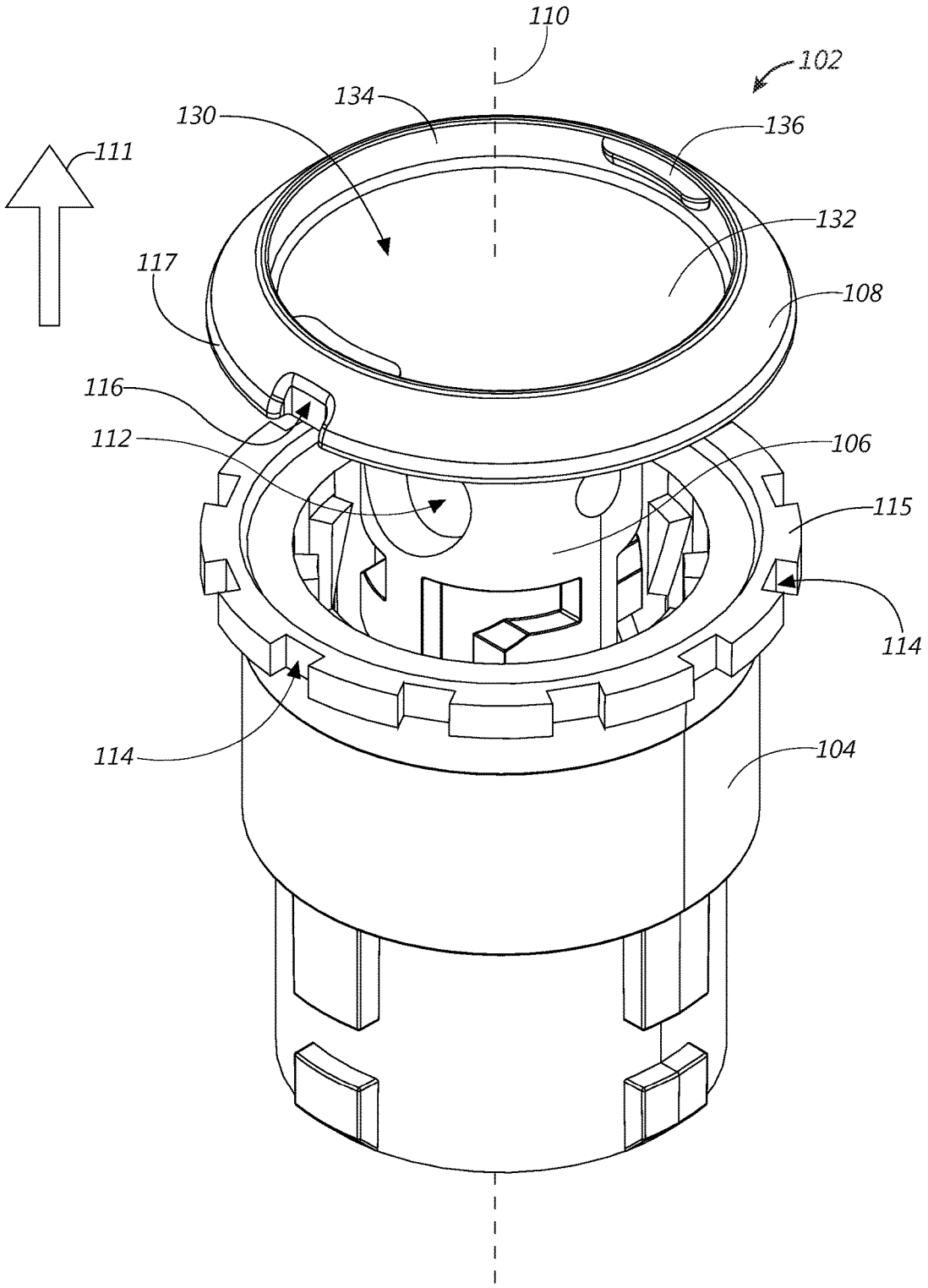
FIG. 1B illustrates an exploded top isometric view of an embodiment of a waterjet apparatus.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally described herein, and illustrated in the figures, may be arranged, substituted, combined, and designed in a wide variety of different configurations, all of which are explicitly contemplated and made a part of this disclosure FIGS. 1A and 1B illustrate one embodiment of a waterjet apparatus 102 disclosed herein. FIG. 1A illustrates a top isometric view and FIG. 1B illustrates an exploded top isometric view of the waterjet apparatus 102. A variety of different materials may be used to manufacture the waterjet apparatus 102. The materials can include high impact plastics that may be fabricated by injection molding. Other materials may be utilized with suitable rigidity and compatibility with the chemicals typically found in, for example, swimming pool or spa environments.

As shown in FIGS. 1A and 1B, the waterjet apparatus 102 generally includes a housing 104, a head 106 movably connected to the housing 104, and a plaster attachment device 108 coupled to the head 106. The housing 104 can be a generally cylindrical sleeve and the head 106 can be positioned inside the housing 104. The plaster attachment device 108 is configured to couple with the head in a manner such that the plaster attachment device 108 fits snugly over the housing 104 when the head is in a retracted configuration and yet does not block waterjet flow from the head 106 when the head is deployed. The plaster attachment device 108 or any component thereof can be integrally formed with the head such as by injection molding or can be attached to the head with any suitable engagement mechanism.

In one implementation, the plaster attachment device 108 has a bottom surface 132 and annular sidewall 134 extending upwardly from the perimeter of the bottom surface 132 to define a plaster opening 130 sized to receive sufficient plaster so that the upper surface of the water jet apparatus appears to have a finish comprised of plaster or plaster mixed in with loosely compacted mass of fragments or particles such as pebbles. The bottom surface 132 can define a depth of the plaster opening 130 along the central axis 110. The sidewalls 134 can define a radius of the plaster opening 130 about the central axis 110. In one implementation, the depth of the plaster opening 130 is 0.5 mm to 1.5 mm and the diameter of the plaster opening 130 is 3.5 mm to 9 mm. The sidewalls 134 can be angled relative to a central axis 110 to improve the mechanical bond of the plaster within the plaster attachment device 108. The plaster attachment device 108 can have flanges or other protrusions, bosses, grooves, indentations, and/or the like to facilitate securing the plaster in the plaster opening 130. The plaster attachment device 108 can also include slots for mating with maintenance tools where, for example, surface finish area is maximized relative to the dimension (e.g., diameter) of the waterjet apparatus 102.

As further shown in FIGS. 1A and 1B, the head 106 is spring biased and movable relative to the housing 104 along a central axis 110 (e.g., slides along directional arrow 111). The head 106 can move up and down along a central or center axis 110 (e.g., along or oppositely directional arrow 111, respectively) upon delivery of pressurized water to the head 106. The head 106 can reciprocate intermittently relative to the housing 104 with pressurized water in a manner known in the art. The central axis 110 can be considered an axis from which the waterjet apparatus 102 extends from in a radial and substantially symmetrical manner (e.g., when the waterjet apparatus is circular or even square) and/or along which the head 106 reciprocates as discussed herein.

The housing 104 of the waterjet apparatus 102 can be secured to a housing, such as a sleeve or other similar structure, mounted in the floor or walls of a pool or spa. As pressurized water is delivered or supplied to the head 106, the head 106 can move up along the central axis 110 to deliver pressurized water in a desired direction. The head 106 can deliver pressurized water through an opening or orifice 112 (e.g., a nozzle opening) in a manner known in the art. The orifice 112 can house or engage, mate, or connect with a nozzle to control the desired water flow or jet formed from the head 106.

As discussed herein, upon delivery of pressurized water, the head 106 reciprocates or moves up relative to the housing 104 along the central axis 110 in a direction of the directional arrow 111 to an operating position as illustrated in FIG. 1B. Further, the head 106 can rotate about the central axis 110 upon delivery of the pressurized water. After delivery of the pressurized water, the head 106 can lower back into a resting position against the housing 104 as illustrated in FIG. 1A. As the head 106 returns to its resting position against the housing 104, the head 106 can further rotate about the central axis 110 to rest in a desired or predetermined position relative to the housing 104.

Figure 2:
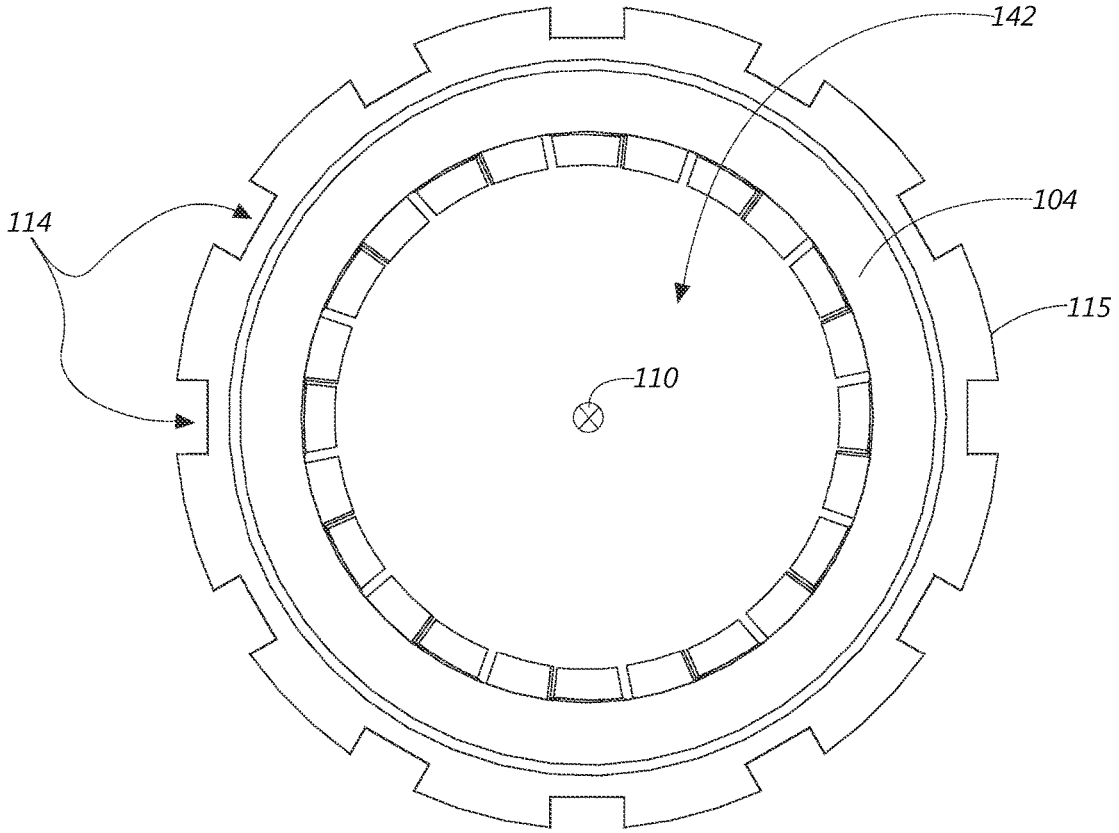
FIG. 2 illustrates a top view of an embodiment of a housing.

As illustrated in FIGS. 1A and 1B, the housing can have slots, slits, or cutouts 114. FIG. 2 illustrates a top view of an embodiment of the housing 104. The slots 114 can be positioned along a perimeter or periphery 115 of the housing 104 (e.g., radially outermost surface of the housing 104). As illustrated in FIG. 2, housing 104 may be round or circular. As illustrated in FIGS. 1A and 1B, the head 106 and the plaster attachment device 108 can be correspondingly circular or round. In some embodiments, the components of the waterjet apparatus 102 can be circular or have other shapes while achieving the desired functionality as discussed herein. For example, the housing 104 maybe a square, pentagon, hexagon, etc.

As illustrated in FIG. 2, the slots or slits 114 can be rectangular indentations along the perimeter or periphery 115 of the housing 104. The slots 114 can be considered cutouts along an outermost periphery (e.g., periphery 115) of the housing 104. The slots 114 can have any suitable shape or size to connect, mate, and/or engage a maintenance tool. The maintenance tool can be used to rotate the housing 104 to, for example, remove it from the housing mounted in the bottom surface or wall containing the artificial body of water. The housing 104 can have twelve slots 114 disposed equidistantly from each other about the central axis 110. In some embodiments, the housing 104 can have between six and twenty four slots 114, including six and twenty slots 114, including ten and sixteen slots 114, including the foregoing values and ranges bordering therein.

Figure 3:
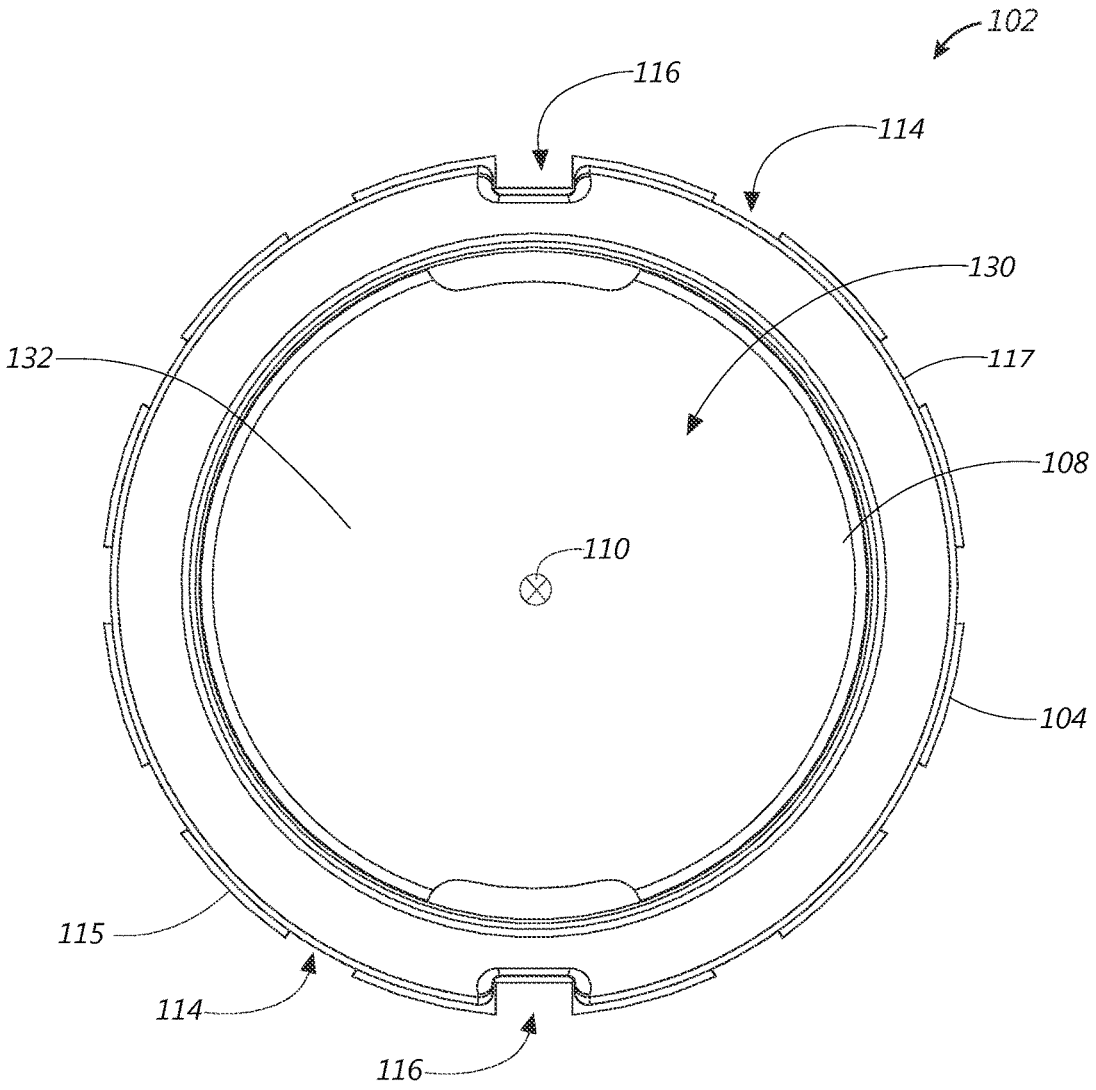
FIG. 3 illustrates a top view of an embodiment of a waterjet apparatus.

FIG. 3 illustrates a top view of an embodiment of the waterjet apparatus 102. FIG. 3 illustrates the plaster attachment device 108 resting on the housing 104 of the apparatus 102 in a snug matter as discussed herein. As illustrated in FIG. 3, the plaster attachment device 108 can have slots, slits, or cutouts 116 along a perimeter or periphery 117 of the plaster attachment device 108. The slots 116 can be considered cutouts along a radially outermost periphery (e.g., periphery 117) of the plaster attachment device 108. The slots 116 can have any suitable shape or size to allow a maintenance tool to pass through the slots 116 and connect, mate, and/or engage the slots 114 of the housing 104 as discussed herein.

As illustrated in FIG. 3, the plaster attachment device 108 can have two diametrically opposing slots 116. As discussed herein, the head 106, and correspondingly the plaster attachment device 108, can rotate about the central axis 110 during and after delivery of pressurized water. The internal mechanisms of the waterjet apparatus 102 as discussed herein can be arranged such that after delivery of pressurized water, the head 106 and the plaster attachment device 108 rest on the housing 104 such that the slots 116 of the plaster attachment device 108 align with the slots 114 of the housing 104 along the central axis 110.

As the plaster attachment device 108 rotates with the head 106 during operation, the head 106 and the plaster attachment device 108 come to rest such that the slots 116 of the plaster device 108 align with the slots 114 of the housing 104. During operation, the slots 116 of the plaster attachment device 108 can correspondingly sequentially align with each of the slots 114 of the housing 104 as the head 106 intermittently rotates about the central axis 110 during operation.

In some embodiments, the plaster attachment device 108 can have one to five slots 116 that are spaced apart, including three slots 116. In some embodiments, the radius, length, or diameter of the periphery 117 of the plaster attachment device 108 may be smaller, shorter, or less than the radius, length, or diameter of the periphery 115 of the housing 104 such that the plaster attachment device 108 may not include any slots 116 to allow access to the slots 114 via a maintenance tool as discussed herein. The periphery 117 may not substantially coincide, align, or overlap with the periphery 115 along the central axis 110 via the periphery 115 being longer or greater than in radius, length, or diameter relative to the periphery 117.

Figure 4:
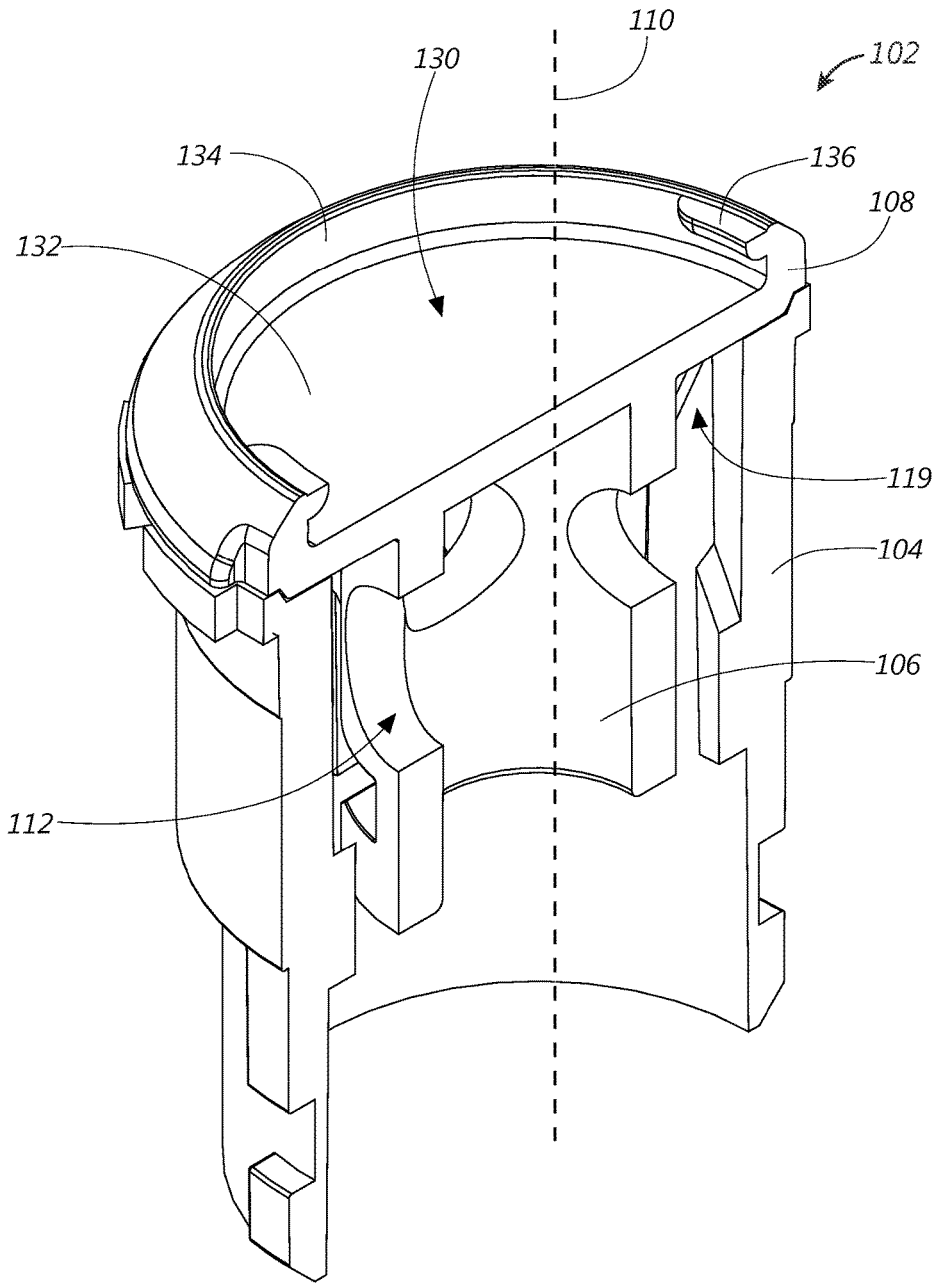
FIG. 4 illustrates a cross-sectional top isometric view of an embodiment of a waterjet apparatus.
Figure 5:
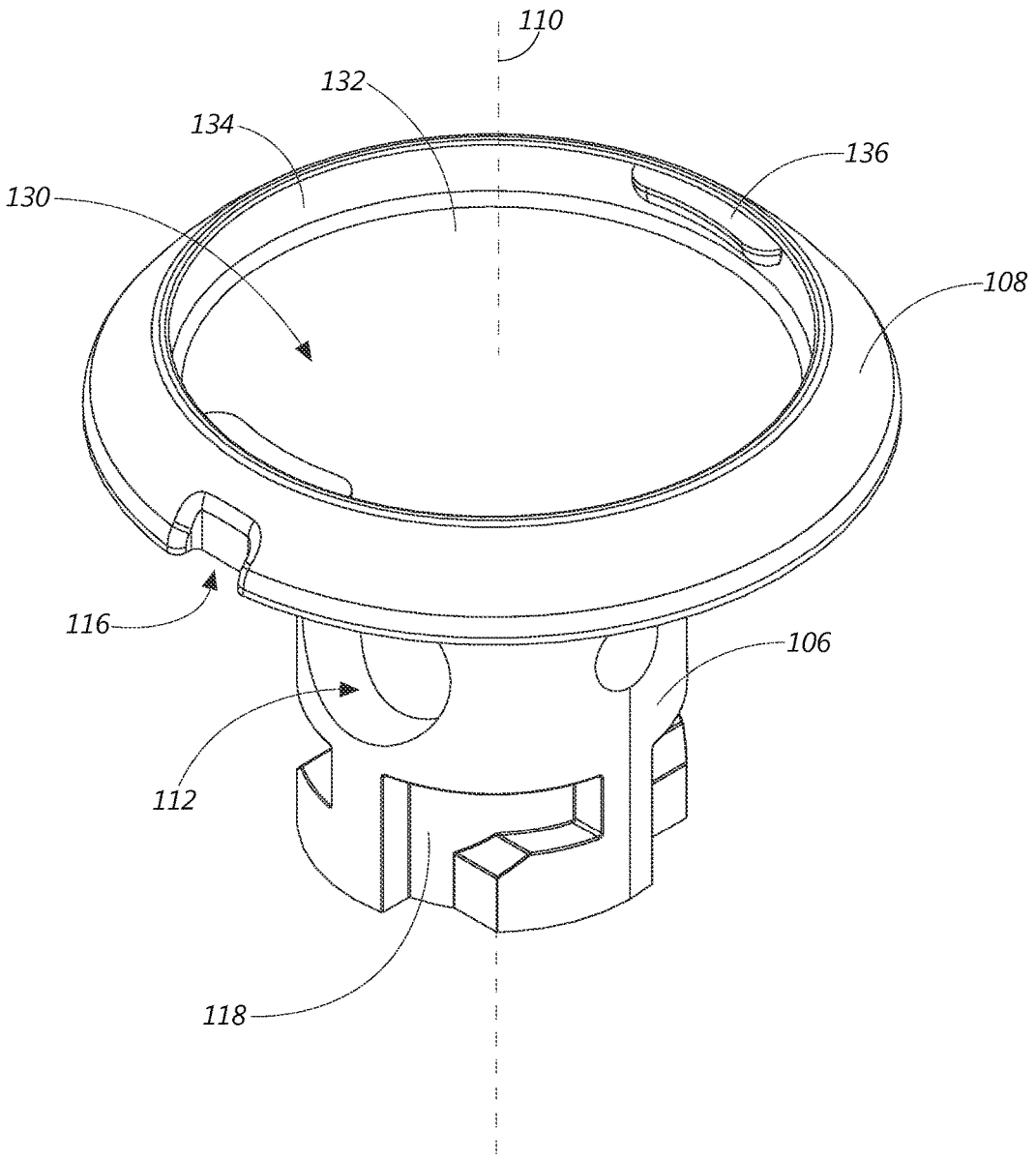
FIG. 5 illustrates a top isometric view of an embodiment of a head and a plaster device.

FIG. 4 illustrates a cross-sectional top isometric view of an embodiment of the waterjet apparatus 102. As illustrated in FIG. 4, the head 106 can be sized and shaped to fit within an inner cavity or volume 119 of the housing 104. FIG. 5 illustrates a top isometric view of an embodiment of the head 106 and the plaster attachment device 108. The head 106 can have indentations or slots 118 that can mate, connect, and/or mate with a tube 120, such as a spring tube or spring sleeve.

Figure 6A:
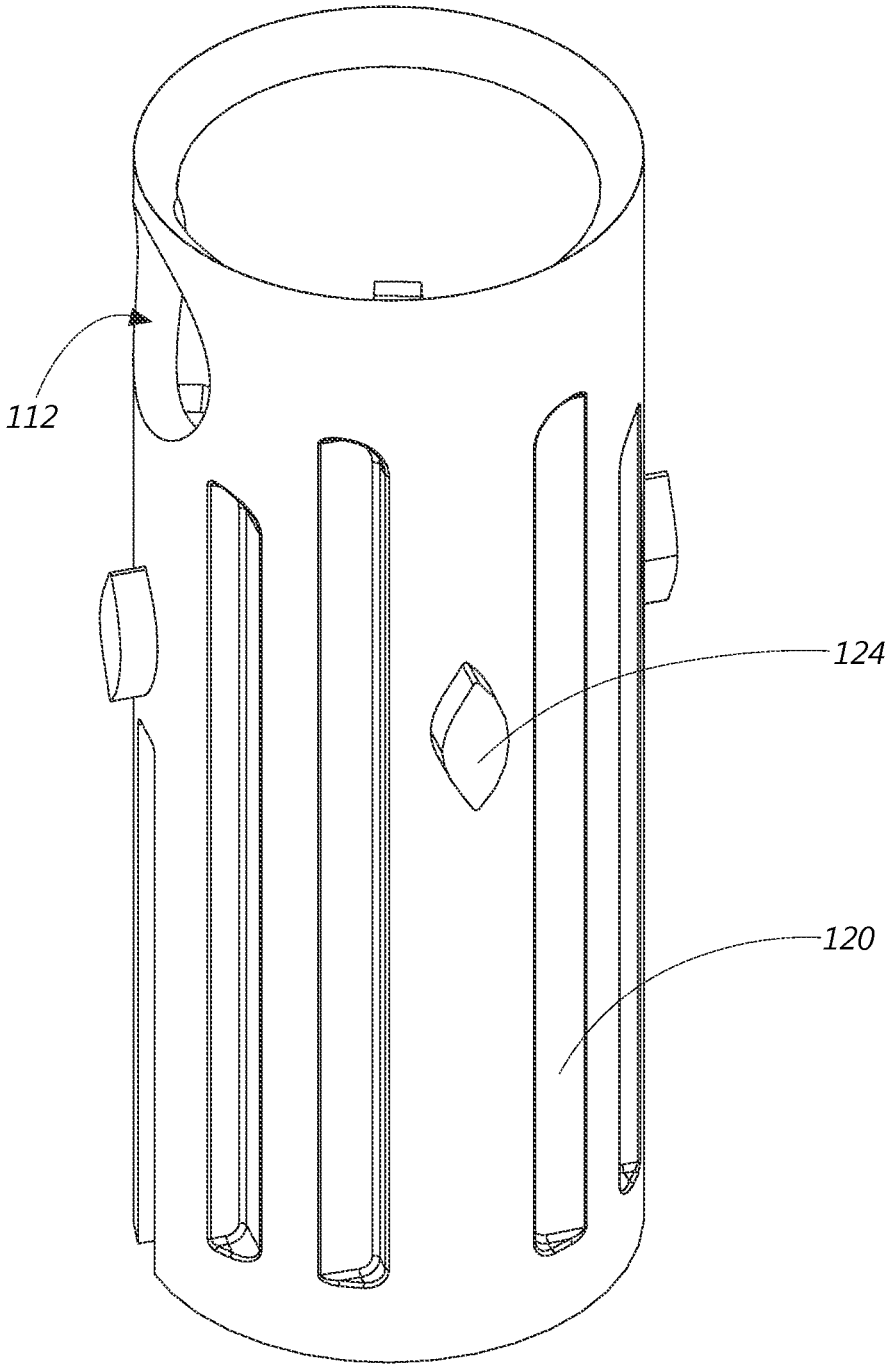
FIG. 6A illustrates a top side view of a tube.
Figure 6B:
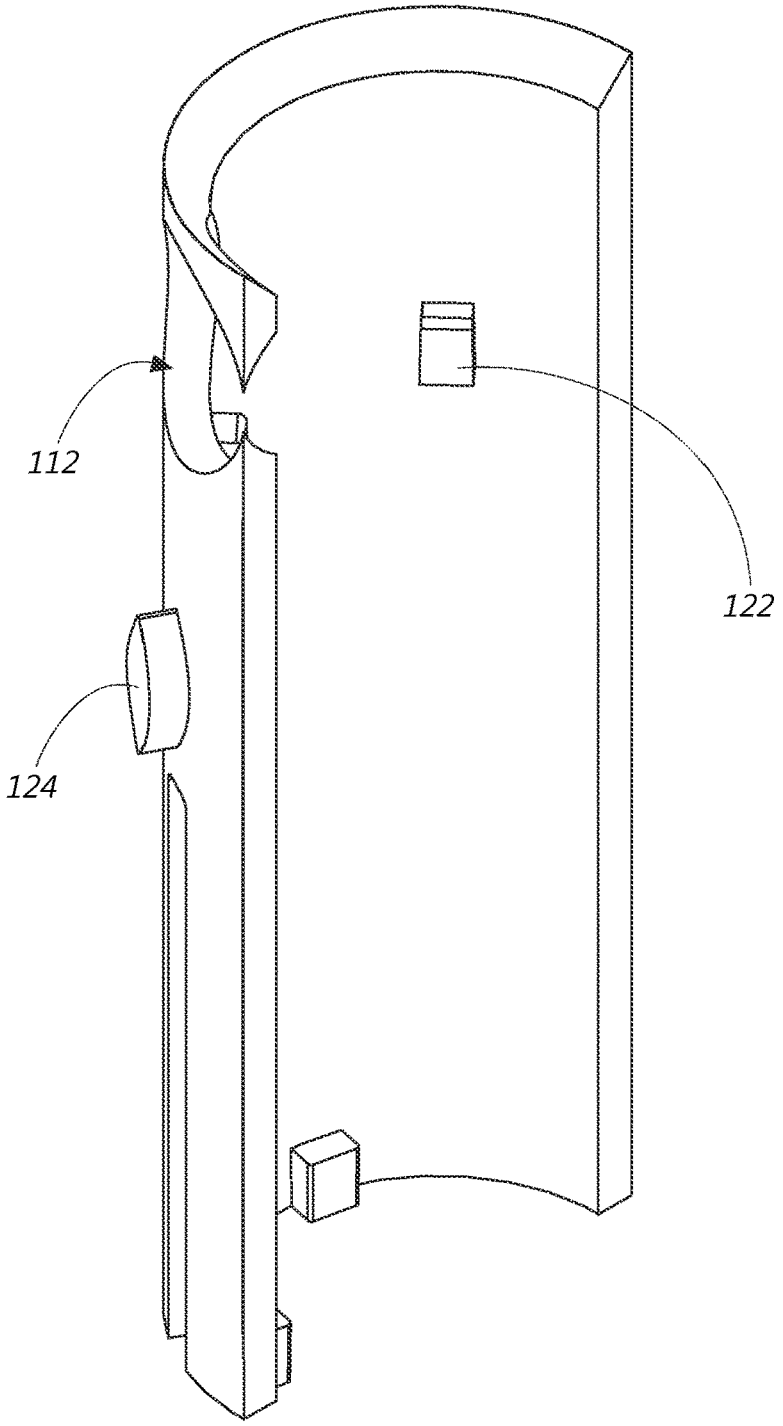
FIG. 6B illustrates a cross-sectional top side view of a tube.

FIG. 6A illustrates a top side view of the tube 120, which can serve as a water conduit. FIG. 6B illustrates a cross-sectional top side view of the tube 120. The tube 120 can have protrusions or projections 122 that engage, mate, and/or connect with indentations 118 on the head 106. For example, the tube 120 can be slid up onto and over the head 106 along the central axis 110 (e.g., tube 120 circumscribes or is on the outside of the head 106). The projections 122 can slide into the indentations 118 along the central axis 110. The head 106 and/or tube 120 can be rotated about the central axis 110 such that the projections 122 slide into a substantially closed or three-sided part of the indentations 118 to lock or securely engage the tube 120 relative to the head 106. The tube 120 can be positioned between housing 104 and the head 106 of the volume 119 illustrated in FIG. 4. The tube 120 can have outward protrusions or projections 124 (e.g., knobs or bosses) that operatively engage the housing 104 to rotate the head 106 and the plaster device 108 as discussed herein.

In some embodiments, the indentations 118 and the projections 122 can be mirrored, when for example, the head 106 is designed to slide over the sleeve 120. For example, FIG. 30 illustrates an embodiment where the indentations 118 are positioned on the head 106 and the projections 122 are positioned on the sleeve 120 to engage as discussed herein. Similar mirroring can be provided for the any other engagement mechanisms discussed herein for the various embodiments of the waterjet apparatuses 102 disclosed herein.

Figure 7:
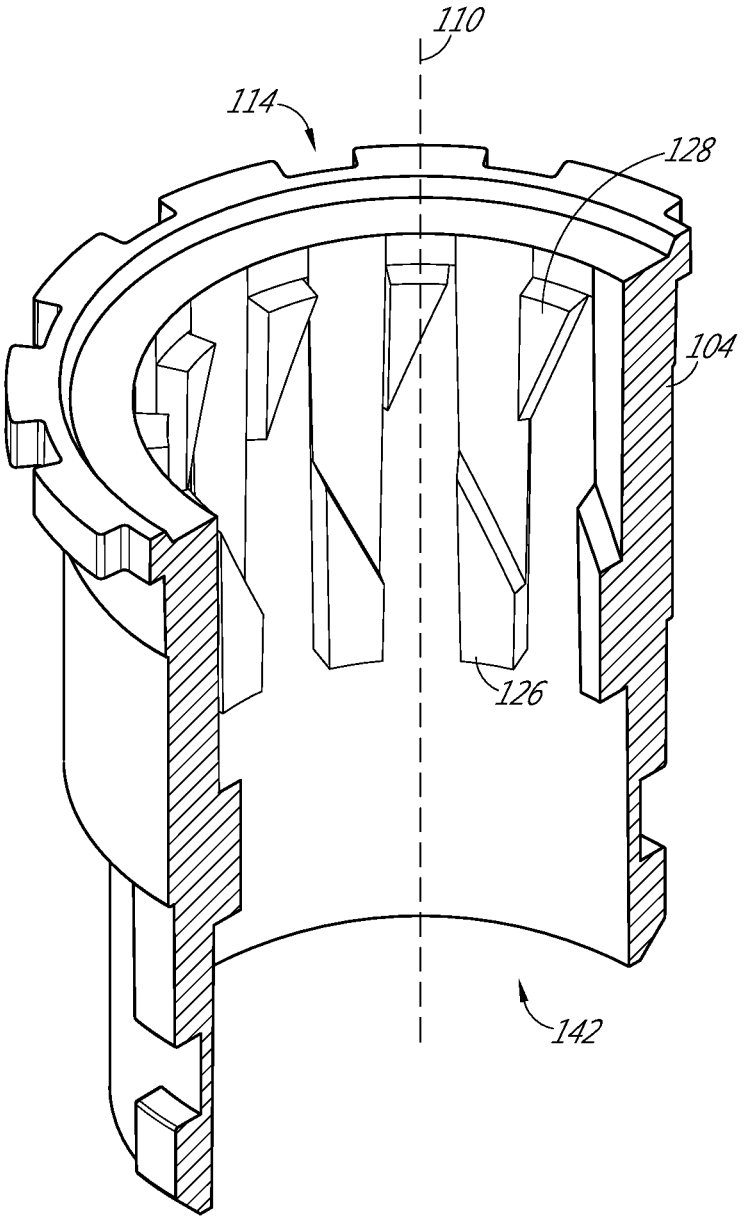
FIG. 7 illustrates a cross-sectional top isometric view of an embodiment of a housing.

FIG. 7 illustrates a cross-sectional top isometric view of an embodiment of the housing 104 of the waterjet apparatus 102. The housing 104 can have lower ridges 126 and upper ridges 128 (e.g., protrusions, projections, and/or bosses). When the head 106 reciprocates as discussed herein, the tube 120 can substantially move with the head 106. Operably moving upward along the central axis 110 (e.g., along directional arrow 111), projections 124 of the tube 120 engage the upper ridges 128 to at least partially rotate the head 106 and the plaster attachment device 108 along the central axis 110. After the delivery of pressurized water, the head 106, the plaster attachment device 108, and the tube 120 correspondingly move downwardly along the central axis 110. When moving downwardly, the projections 124 of the tube 120 engage the lower ridges 126 to further rotate the head 106 about the central axis 110. The engagement of the projections 124 of the tube 120 both in the upward direction (e.g., along directional arrow 111) and in the downward direction (e.g., opposite directional arrow 111) with the upper ridges 128 and lower ridges 126, respectively, can be considered a rotational movement of the plaster attachment device 108 corresponding to a single reciprocal movement of the head 106 as discussed herein.

Upon a full single reciprocal movement of the head 106 and the plaster attachment device 108, the slots 116 of the plaster attachment device 108 can substantially align with the slots 114 of the housing 104 along the central axis 110. Referring to FIG. 3, when the slots 116 of the plaster attachment device 108 align with the slots 114 of the housing 104 a maintenance/mating tool can be inserted along the central axis 110 through the slots 116 of the plaster attachment device 108 to engage, connect, and/or mate with the slots 114 of the housing 104. The upper and lower ridges 126, 128 index the head 106 each time the head 106 is reciprocally operated.

Accordingly, after any number of rotations of the plaster attachment device 108 relative to the housing 104, the maintenance tool can be engaged with the slots 114 of the housing 104 such that the maintenance tool can be rotated about the central axis 110 to rotate the housing 104 about the central axis 110 relative to the wall or surface containing the artificial body of water in order to, for example, remove the waterjet apparatus 102 for maintenance. The lower ridges 126 and the upper ridges 128, as well as the projections 124 of the tube 120, can be sized and shaped to correspond to the slots 114 of the housing 104. For example, as discussed herein, after any number of rotations of the head 106, the slots 114 and the slots 116 can substantially align along the central axis 110 as discussed herein.

As illustrated in FIGS. 1-7, the waterjet apparatus of certain embodiments of the present disclosure include a plaster attachment device 108 configured to house, retain, contain, support, engage and/or allow attachment of plaster, cement, grout, mortar, sand, binder, pebble, rocks, aggregate material and/or a surface finish 107 that matches the surface of the walls or floor of pool, spa, water features, or other artificial bodies of water.

The plaster attachment device 108 has a bottom surface 132 that is coupled to the head and extends substantially radially outward from the central axis 110. The device 108 also has a sidewall 134, which together with the bottom surface 132 define a plaster opening 130 of predetermined size for containing plaster mixtures or the like. The sidewall 134 can be substantially perpendicular to the bottom surface 132. The sidewall 134 can circumscribe or enclose the bottom surface 132. The sidewall 134 can extend circularly about the central axis 110. Sidewall 134 can have a length of about ⅛ inches to 1 inch depending on the plaster used. Accordingly, length of the sidewall 134 along the central axis 110 provides a predetermined or desired depth to the plaster opening 130.

To further facilitate attaching the plaster to the waterjet apparatus, the plaster attachment device 108 can have one or more flanges 136. The flanges 136 can extend radially inward toward the central axis 110 so that they press against plaster. The flanges 136 can help keep the plaster within the plaster opening 130 by substantially inhibiting movement of the plaster out of the plaster opening 130 along the central axis 110. Along with the sidewalls 134 inhibiting movement of the plaster perpendicularly to the central axis 110 and the bottom surface 132 inhibiting movement of the plaster downwardly along the central axis 110, the flanges 136 can help securely fix the plaster within the plaster opening 130 as the plaster attachment device 108 reciprocates with the head 106 as discussed herein. As illustrated in FIGS. 1-7, the plaster attachment device 108 can have two flanges 136. In some embodiments, the plaster attachment device 108 can have one, two, three, four, five, six, or six or more flanges along the opening to provide a desired secured connection of the plaster.

As illustrated in FIG. 1A, the plaster attachment device 108 can radially extend outward such that the periphery 117 of the plaster attachment device 108 can substantially correspond to a periphery 115 of the housing 104. The housing 104 can be sized to connect, mate, and/or engage a sleeve or other opening in the surface or wall containing the artificial body of water. Accordingly, an inner periphery or perimeter of a sleeve or other opening in the surface containing the artificial body of water that can engage the housing 104 can be sized and/or shaped to substantially correspond to the outer perimeter (e.g., perimeter 115) of the housing 104. Accordingly, plaster on the surface or wall containing the artificial body of water can extend substantially up to the or near to the outer perimeter of the housing 104 so that the plaster in the plaster opening 130 is flush with the finish on the surface of the wall. It is desirable to maximize the exposed surface area of the plaster in the plaster opening 130 such that the waterjet apparatus 102 is substantially camouflaged against the plaster mixture of the surface or wall containing the artificial body of water.

Accordingly, the plaster opening 130 can extend substantially a majority of the radial extent of the housing 104 from the central axis 110 such that the plaster opening 130 substantially coincides with the extent of the housing 104 from the central axis 110. With the outer perimeter or peripheries of the housing 104 and the plaster attachment device 108 (e.g., perimeters 115, 117) substantially corresponding or aligning along the central axis 110, the plaster attachment device 108 may have slots 114 of the housing 104 as discussed herein to provide a relatively larger plaster opening 130 radially away from the central axis 110. The slots 116 of the plaster attachment device 108 are therefore provided to allow access toward the housing 104 with a maintenance tool, and in particular, toward the slots 114 of the housing 104 such that the housing 104 can be rotated and disengaged from the opening of the surface containing the artificial body of water while maximizing a length (e.g., diameter) of the plaster openings 130.

An upper surface or plane defining an upper most surface of the housing 104 perpendicular to the central axis 110 can be substantially flush with the surface containing the artificial body of water. Accordingly, the plaster attachment device 108 can protrude or extend along the central axis 110 a predetermined dimension or length above the surface containing the artificial body of water (e.g., along the central axis 110). Such a waterjet apparatus 102, and in particular the head 106 and the plaster device 108, may be desirable as a retrofit upgrade to existing cleaning heads that do not correspond or have a surface that does not match plaster of the surface or wall containing the artificial body of water. For example, the housing 104 and other internal components (e.g., the tube 120) can be retained from the existing cleaning heads that may be previously installed in surface containing the artificial body of water. A body (e.g., head) of an existing cleaning head can be removed (via a maintenance tool) and replaced by the head 106 and the plaster attachment device 108 as discussed herein having plaster to provide a waterjet apparatus 102 that substantially matches or is camouflaged relative to the surface containing the artificial body of water. For example, FIG. 30 and accompanying discussion illustrates an embodiment of the plaster attachment device 108 installed into existing cleaning heads.

Figure 8:
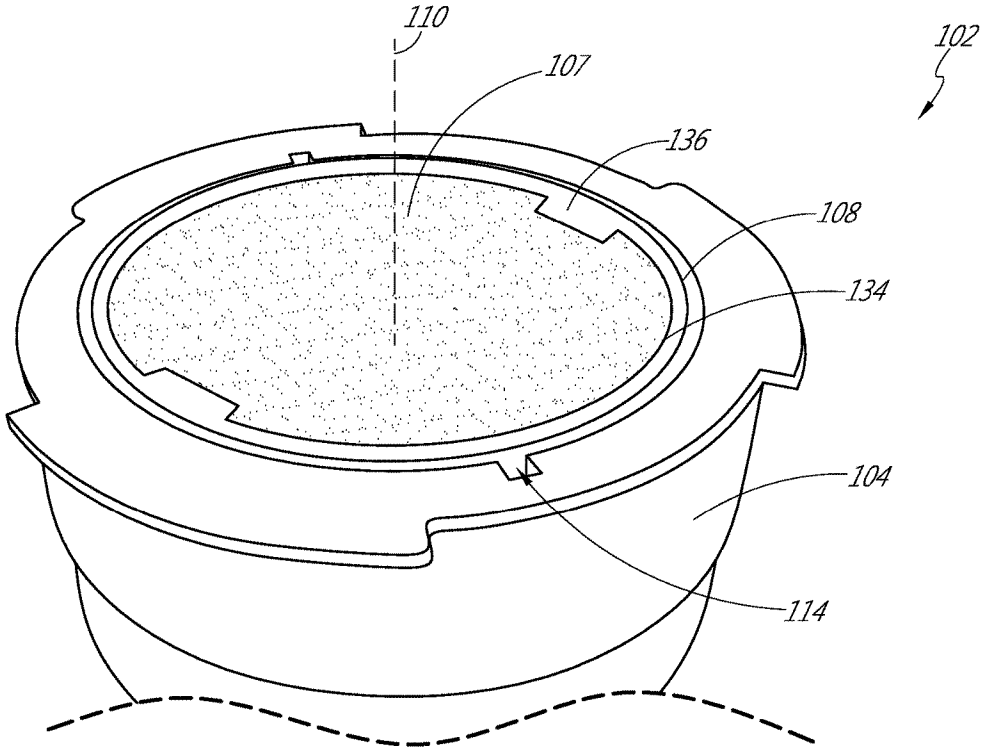
FIG. 8 illustrates a top side view of an embodiment of a waterjet apparatus.

FIG. 8 illustrates a top side view of an embodiment of the waterjet apparatus 102. FIG. 8 illustrates plaster 107 that can be positioned within a plaster opening 130 as discussed herein. The plaster 107 can radially extend up to sidewalls 134. The flanges 136 can extend inwardly toward the central axis 110 over the plaster 107 to help secure the plaster 107 within the plaster opening 130 as discussed herein.

As illustrated in FIG. 8, the plaster attachment device 108 and/or plaster 107 can be substantially flush with an upper surface or plane of the housing 104. For example, internal mechanisms of the waterjet apparatus 102 can be modified, sized, and/or adjusted such that head 106 and the plaster attachment device 108 are lowered into the volume 119 within the housing 104 configured to accept the head 106 and the plaster attachment device 108.

As illustrated in FIG. 8, when the plaster attachment device 108 and plaster 107 are substantially flush with the upper surface or plane of the housing 104, the plaster attachment device 108 will not or will minimally extend over onto housing 104 radially outward from the central axis 110. Accordingly, the plaster attachment device 108 may not have slots 116 as discussed herein. As illustrated in FIG. 8, the housing 104 can have slots 116 that are positioned radially about the plaster attachment device 108 (e.g., about the central axis, circumscribing the perimeter 117 of the plaster attachment device 108). A maintenance tool can be engaged with the slots 114 of the housing 104 without the plaster attachment device 108 and/or plaster 107 interfering or obstructing access to the slots 114.

With the housing 104 as well as the plaster attachment device 108 and plaster 107 being substantially flush with the surface containing the artificial body of water, the waterjet apparatus 102 can be further camouflaged to match the surface containing the artificial body of water. For example, while the waterjet apparatus 102 may have some plastic portions that are not covered by the plaster 107, in particular, uppermost surfaces of the housing 104 as illustrated in FIG. 98, the waterjet apparatus 102 substantially does not physically protrude from or extend beyond the surface level of the surface containing the artificial body of water.

Figure 9:
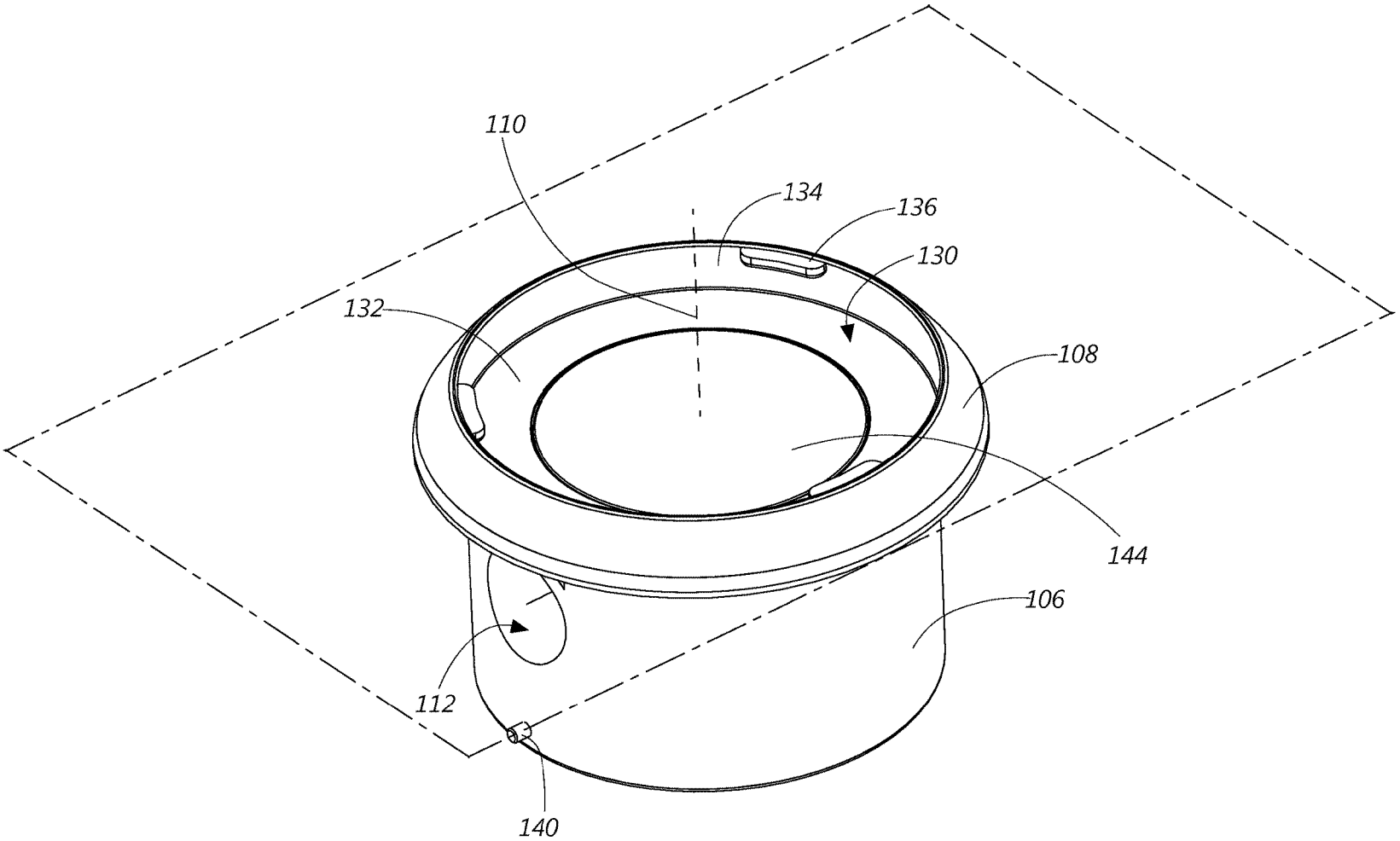
FIG. 9 illustrates a top isometric view of an embodiment of a head and a plaster device.

FIG. 9 illustrates a top isometric view of an embodiment of the head 106 and the plaster attachment device 108 of the waterjet apparatus. The head 106 can have a jet opening or orifice 112 as discussed herein. The plaster attachment device 108 can have engagement mechanisms 140 (e.g., knobs, bosses, and/or protrusions) that mate with internal mechanisms of the waterjet apparatus 102 to function as discussed herein (e.g., reciprocate along the central axis 110 and rotate about the central axis 110 upon delivery of pressurized water). The plaster attachment device 108 can have a plaster opening 130 including a bottom surface 132, a sidewall 134, and/or flanges 136 as discussed herein.

Figure 10:
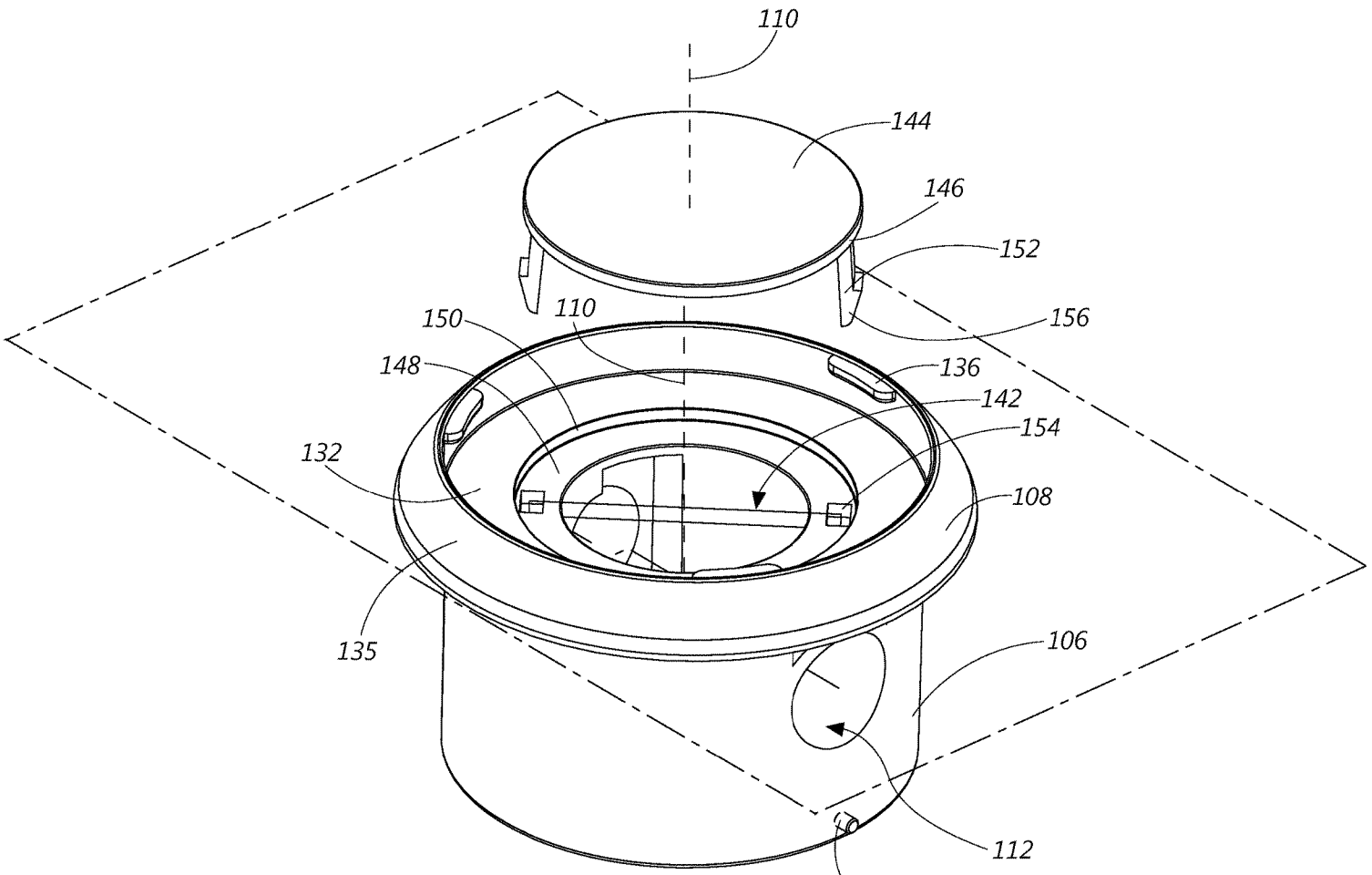
FIG. 10 illustrates an exploded top isometric view of an embodiment of a plaster device and a cover.
Figure 11:
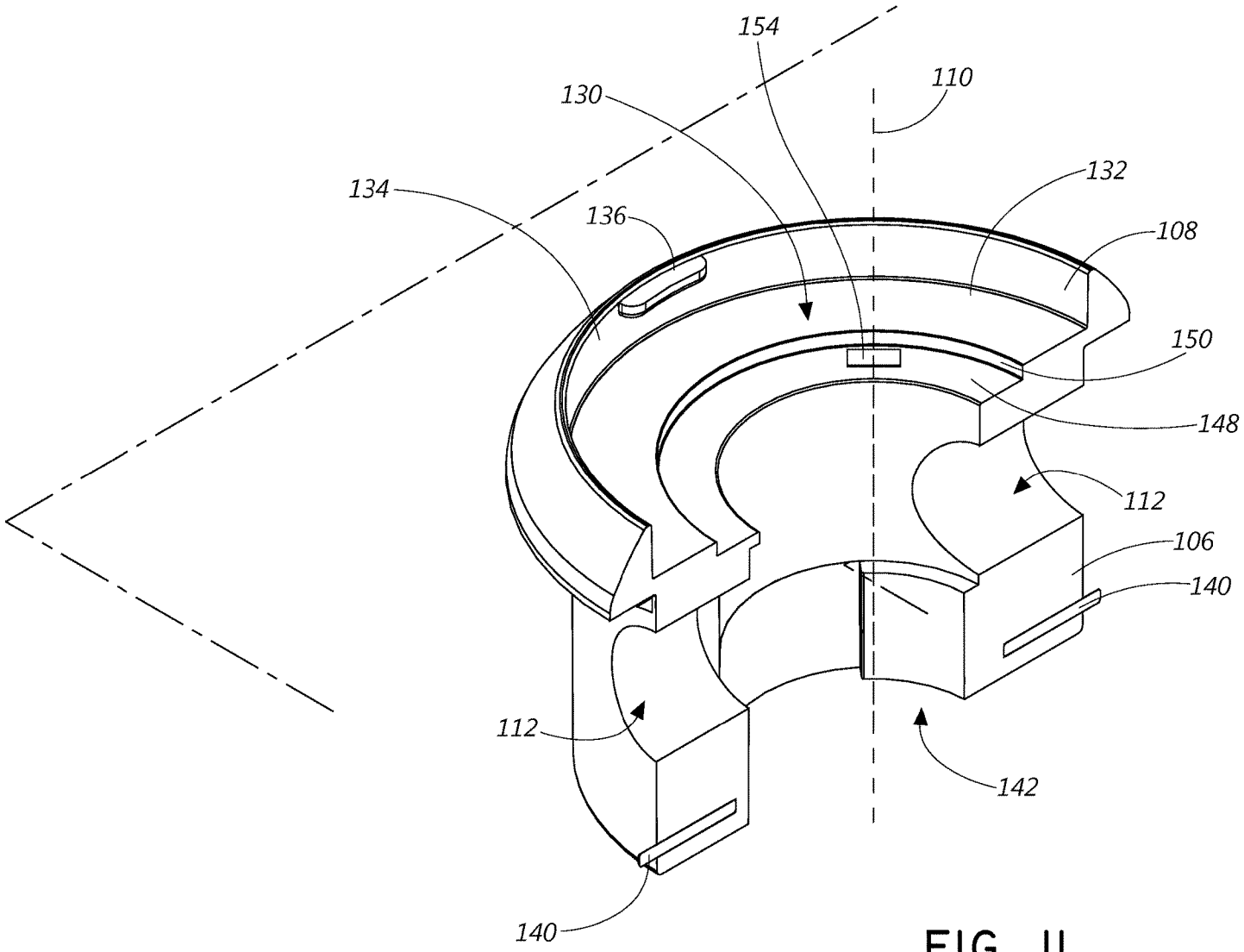
FIG. 11 illustrates a cross-sectional top isometric view of embodiments of a head and a plaster device.

FIG. 10 illustrates an exploded top isometric view of an embodiment of the plaster attachment device 108 comprising a recessed base 144 and a rim 135 encircling the recessed base 144. FIG. 11 illustrates a cross-sectional top isometric view of embodiments of the head 106 and the plaster attachment device 108. FIGS. 9-11 illustrate an embodiment of the head 106 and/or plaster attachment device 108 that can be retrofitted onto an existing cleaning head as discussed herein. Accordingly, the plaster attachment device 108 may protrude above a surface or plane of the surface containing artificial body of water. For example, the embodiment of the head 106 and plaster attachment device 108 illustrated in FIGS. 9-10 can be used with the housing 104 in FIGS. 1, 2, 4, and 5 with the slots 114 positioned on the periphery 115 of the housing 104.

In some embodiments, the plaster attachment device 108 may not radially extend over onto the slots 114 from the central axis 110. Accordingly, the plaster attachment device 108 may not include slots 116 at a periphery of the plaster attachment device 108 (e.g., periphery 117) as illustrated in FIGS. 9-11 while still allowing a maintenance tool to interface with slots 114 of the housing 104. The plaster attachment device 108 can have a smaller diameter or radius from the central axis 110 relative to the diameter or radius from the central axis 110 of housing 104, and in particular, relative to the radius at which the slots 114 are positioned about the central axis 110. In some embodiments, the housing 104 may have 1, 2, 3, 4, or 4 slots 114 positioned about the periphery 115.

The head 106 and/or plaster attachment device 108 can have a central opening 142 along the central axis 110. The central opening 142 can direct pressurized water through the head 106. Further, because of some manufacturing and/or molding processes, the central opening 142 may extend through the bottom surface 132 of the plaster opening 130 as illustrated in FIGS. 10 and 11.

In order to secure the plaster 107 as discussed herein in a desired or predetermined position, the plaster attachment device 108 can include a recessed base 144 having an outer perimeter or periphery 146 that is relatively larger or greater in radius/diameter than the radius/diameter of the central opening 142. Accordingly, the recessed base 144 can be positioned downwardly (e.g., oppositely of directional arrow 111 along the central axis 110) onto the head 106 and/or the bottom surface 132. With the head 106 and/or the bottom surface 132 supporting the recessed base 144 along the central axis 110, the plaster 107 can be placed in the plaster opening 130 as discussed herein with the recessed base 144 providing support for the plaster 107 such that the plaster 107 substantially does not pass through to the central openings 142.

As illustrated in FIGS. 10 and 11, the plaster attachment device 108 can have a lip 148 circumscribing central opening 142 about the central axis 110 (e.g., a flange extending from the central openings 142). The lip 148 can be defined by or have an outer perimeter or periphery 150 (e.g., sidewall) extending about the central axis 110. The periphery 150 can substantially correspond to the periphery 146. For example, the periphery 150 of the head 106 can radially extend a substantially same or slightly larger distance (e.g., length or diameter) from the central axis 110 relative to the diameter or length of the periphery 146 of the recessed base 144. Accordingly, upon connecting, engaging, and/or mating the recessed base 144 over or onto plaster device 108, the periphery 150 of the head 106 can engage or circumscribe the periphery 146 of the recessed base 144 to substantially prevent or inhibit lateral movement of the recessed base 144 in a direction perpendicular to the central axis 110.

As illustrated in FIG. 10, the recessed base 144 can have protrusions or projections 152. The lip 148 can have indentations, openings, and/or cutouts 154 corresponding to the projections 152 along the central axis 110. As the recessed base 144 is placed over the head 106 as discussed herein to cover the central opening 142, cutouts 154 can engage projections 152 to securely connect the recessed base 144 to the head 106. Further, the projections 152 can have outwardly extending portions or projections 156 that engage the wall or surface of the cutouts 154 once the projections 152 are positioned within the cutouts 154 to connect the recessed base 144 to the head 106. Other suitable mating connections can include interference fit mechanisms, snap fit mechanisms, and the like, which can include using male and female mating parts (e.g., tongue-and-groove corresponding parts as illustrated in FIG. 11).

The recessed base 144 can connect to the head 106 via, for example, the projections 152 securely connecting to the cutouts 154 to allow the recessed base 144 to direct pressurized water to the orifice 112 as discussed herein. For example, as the pressurized water comes up the central opening 142 along the central axis 110, the pressurized water will come against or be impeded by the recessed base 144 and directed radially outward toward the orifice 112. Accordingly, there may be upward pressure or forces on the recessed base 144 from the pressurized water coming through the central opening 142 along the central axis 110. The projections 152 can facilitate securely fastening the recessed base 144 along central axis 110 relative to head 106 such that the recessed base 144 does not or substantially does not push against the plaster 107 to mitigate cracks in or breakup of the plaster 107.

As illustrated in FIG. 10, when the recessed base 144 is positioned onto the head 106 in the plaster opening 130 in a desired or predetermined position as discussed herein, the bottom surface 132 can be substantially flush with the recessed base 144 (e.g., a top surface, support surface, or plane of the bottom surface 132 and a top surface, support surface, or plane of the recessed base 144 can be substantially flush). The plaster 107 can be placed in the plaster opening 130 as discussed herein while the recessed base 144 provides support for the plaster 107 to substantially not enter or pass through to the central opening 142.

In some embodiments, the uppermost surfaces of the bottom surface 132 and the recessed base 144 do not have to be flush. For example, the head 106 may not have a lip 148 forming an indentation in the bottom surface 132 to allow the recessed base 144 to lower along the central axis 110 to be flush with the bottom surface 132. The recessed base 144 may be lowered directly onto the bottom surface 132 to engage the head 106 via any suitable mating mechanism as discussed herein. Accordingly, the plaster 107 can be placed in plaster opening 130 with the plaster 107 adopted to or conforming to various contour surfaces of the plaster opening 130 and/or the recessed base 144. For example, such a nonplanar surface of the plaster opening 130 is illustrated in FIG. 12.

Figure 12:
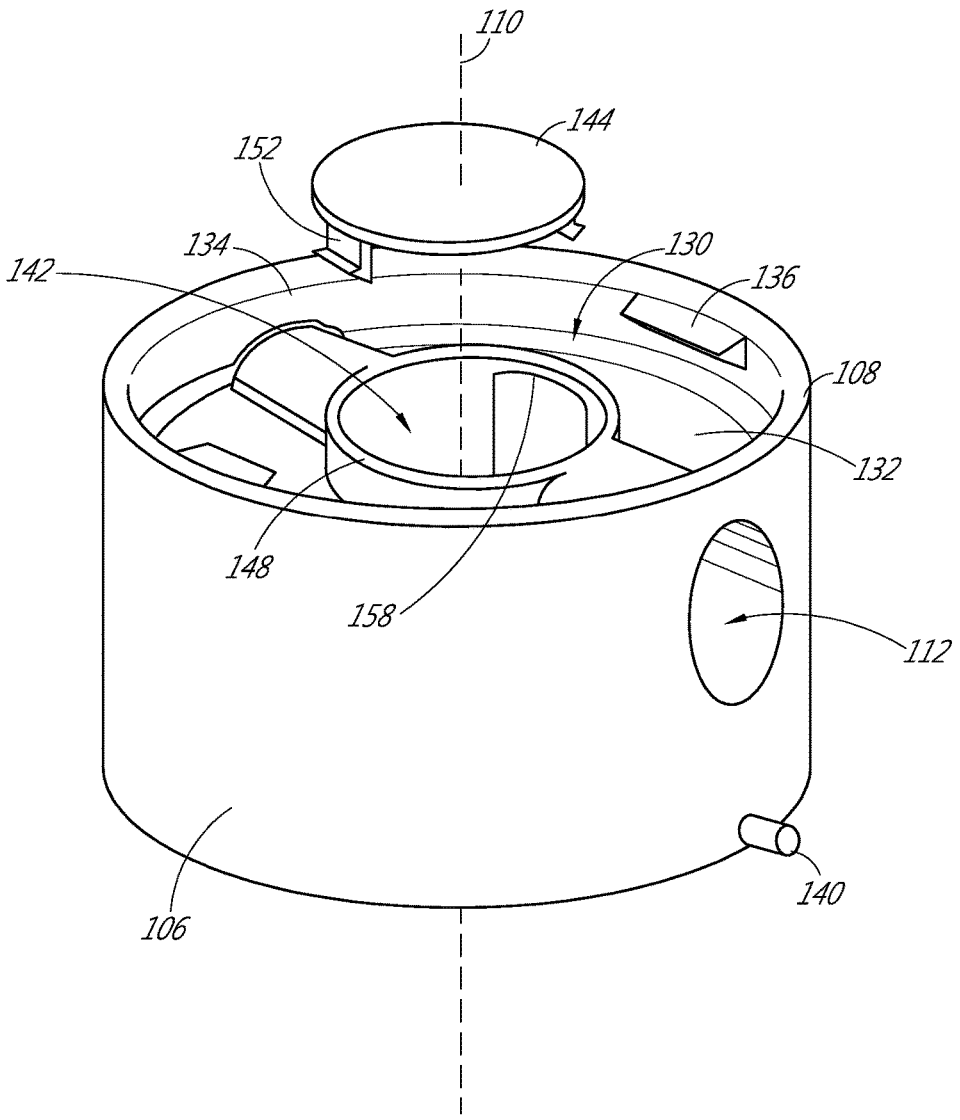
FIG. 12 illustrates an exploded top isometric view of embodiments of a head and a cover.

FIG. 12 illustrates an exploded top isometric view of embodiments of the head 106 and the recessed base 144. FIG. 12 illustrates an embodiment that can be substantially flush with wall or surface plane containing the artificial body of water. For example, such a flush arrangement is illustrated in FIG. 8. As illustrated in FIG. 12, the plaster opening 130 does not have a substantially planar bottom surface 132. The bottom surface 132 may have contours, protrusions, breaks, and/or other features that accommodate the internal mechanisms of the head 106, such as for example, the jet orifice 112. Such an arrangement may be desirable for a low profile head 106 and/or plaster attachment device 108 to provide an arrangement of the plaster 107 being substantially flush with the surface containing the artificial body of water. For example, the head 106 and the plaster attachment device 108 illustrated in FIG. 12 may be lowered along the central axis 110 into the housing 104 illustrated in FIG. 8 such that the upper surface of the housing 104 is substantially flush with the upper surface of the plaster device 108 and/or plaster 107.

As illustrated in FIG. 12, the lip 148 may not have periphery 150 as discussed herein in reference to FIG. 11. As illustrated in FIG. 12, the recessed base 144 can be positioned onto or over lip 148 along the central axis 110. Upon positioning the recessed base 144 onto the lip 148, projections 152 can engage indentations 158 of the body 106. For example, as illustrated in FIG. 12, indentations 158 can be formed in the opening 142 such that extending portions 156 can engage the indentations 158 when the recessed base 144 is lowered onto the lip 148. Accordingly, the projections 152 can prevent or substantially inhibit upward movement of the recessed base 144 along the central axis 110 or lateral movement of the recessed base 144 perpendicular to the central axis 110. When the recessed base 144 is positioned over the central opening 142 as discussed herein, the plaster 107 can be positioned into the plaster opening 130. The plaster 107 can form around and accommodate all of the various nonplanar features of the plaster opening 130 as discussed herein.

Figure 13:
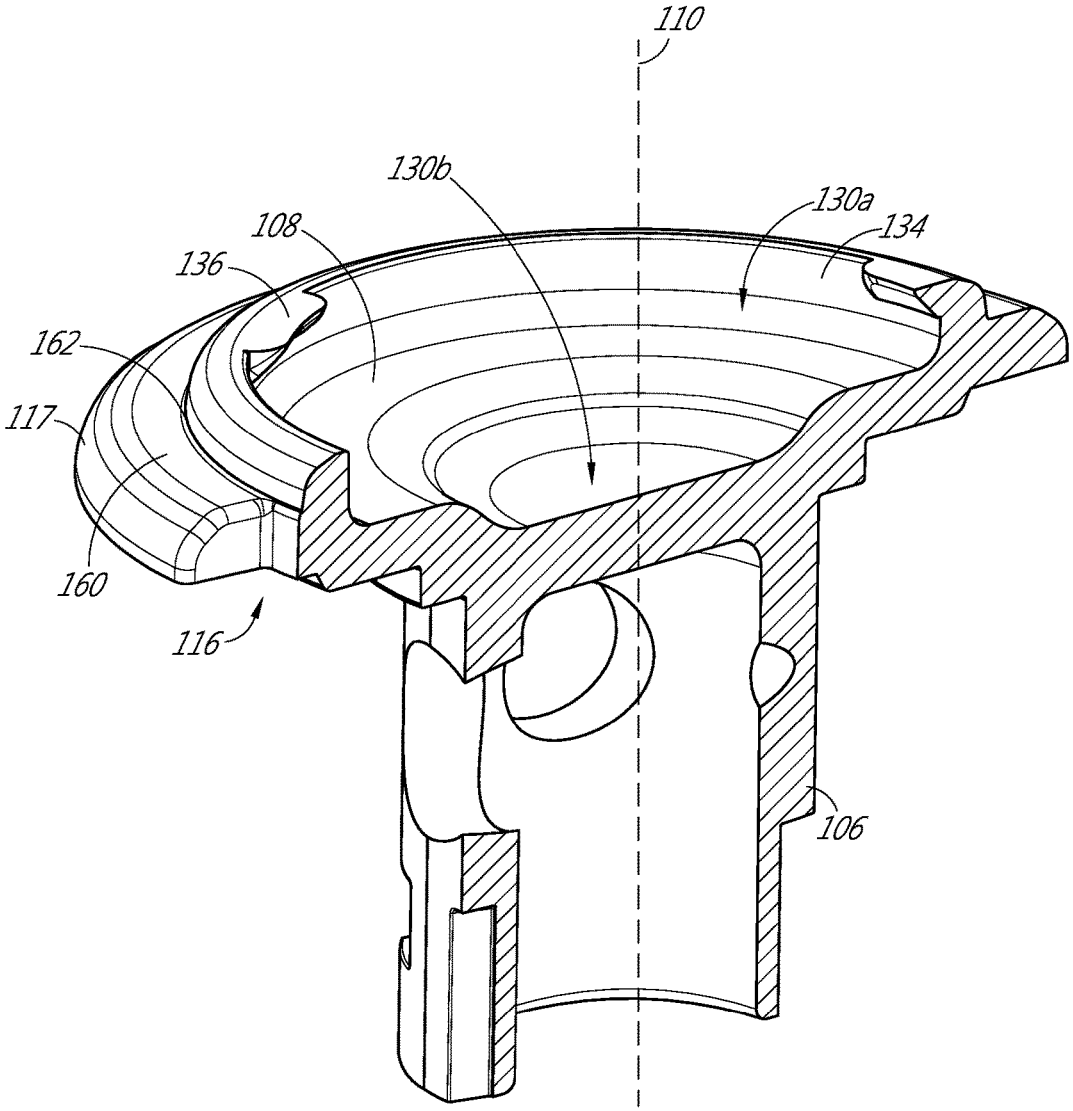
FIG. 13 illustrates a top isometric view of an embodiment of a head and a plaster device.

FIG. 13 illustrates a top isometric view of an embodiment of the head 106 and the plaster attachment device 108. The head 106 can have a jet opening or orifice 112 as discussed herein. The plaster attachment device 108 can have engagement mechanisms 140 (e.g., knobs, bosses, and/or protrusions) that mate with internal mechanisms of the waterjet apparatus 102 to function as discussed herein (e.g., reciprocate along the central axis 110 and rotate about the central axis 110 upon delivery of pressurized water). The plaster attachment device 108 can have a plaster opening 130 including a bottom surface 132, a sidewall 134, and/or flanges 136 as discussed herein.

As illustrated in FIG. 13, the plaster attachment device 108 can have a plaster opening 130 of varying depth. For example, a first portion plaster opening 130*a* can have a first depth along the central axis relative to the sidewall 134. The first portion plaster opening 130*a* may have a depth that corresponds to a height of the sidewall 134 along the central axis 110. With continued reference to FIG. 14, the plaster opening 130 can have a second portion 130*b* of a different depth from the first portion 130*a*. For example, the depth of the second portion 130*b* be may be greater than the depth of the first portion 130*a* along the central axis 110.

The varying depth of the plaster opening 130 can provide a greater volume for plaster 107. But having a greater volume for the plaster 107 may provide a greater variety of plaster that can be used with the plaster device 108. Further, having a second portion 130*b* of greater depth may provide greater structural integrity of the plaster 107 as well as facilitate retention of the plaster 107 in the plaster opening 130.

With continued reference to FIG. 13, the plaster attachment device 108 can have a flange 160 disclosed about the circumference of the plaster device 108 or about the central axis 110. The flange 160 can be connected to and/or be an extension of the sidewall 134. Flange 160 can connect to the sidewall 134 such that a break 162 is formed between the sidewall 134 and the flange 160. The break 162 can include a non-uniform surface or an abrupt change in the surface transitioning from the sidewall 134 to the flange 160.

A maintenance tool as discussed herein can be directed downward toward the waterjet apparatus 102 along the central axis 110. Upon reaching the plaster attachment device 108, the maintenance tool can be brought down around the sidewall 134 along the central axis 110 such that the maintenance tool is aligned along the central axis 110. The prongs of the maintenance tool can rest on top of the flange 160 aligned along the central axis 110. The maintenance tool can be rotated to align the prongs of the maintenance tool with the slots 116 of the plaster attachment device 108. Upon alignment of the prongs with the slots 116, the maintenance tool can be further brought down along the central axis 110 such that the prongs of the maintenance tool engaged the slots 116 as discussed herein.

Figure 14:
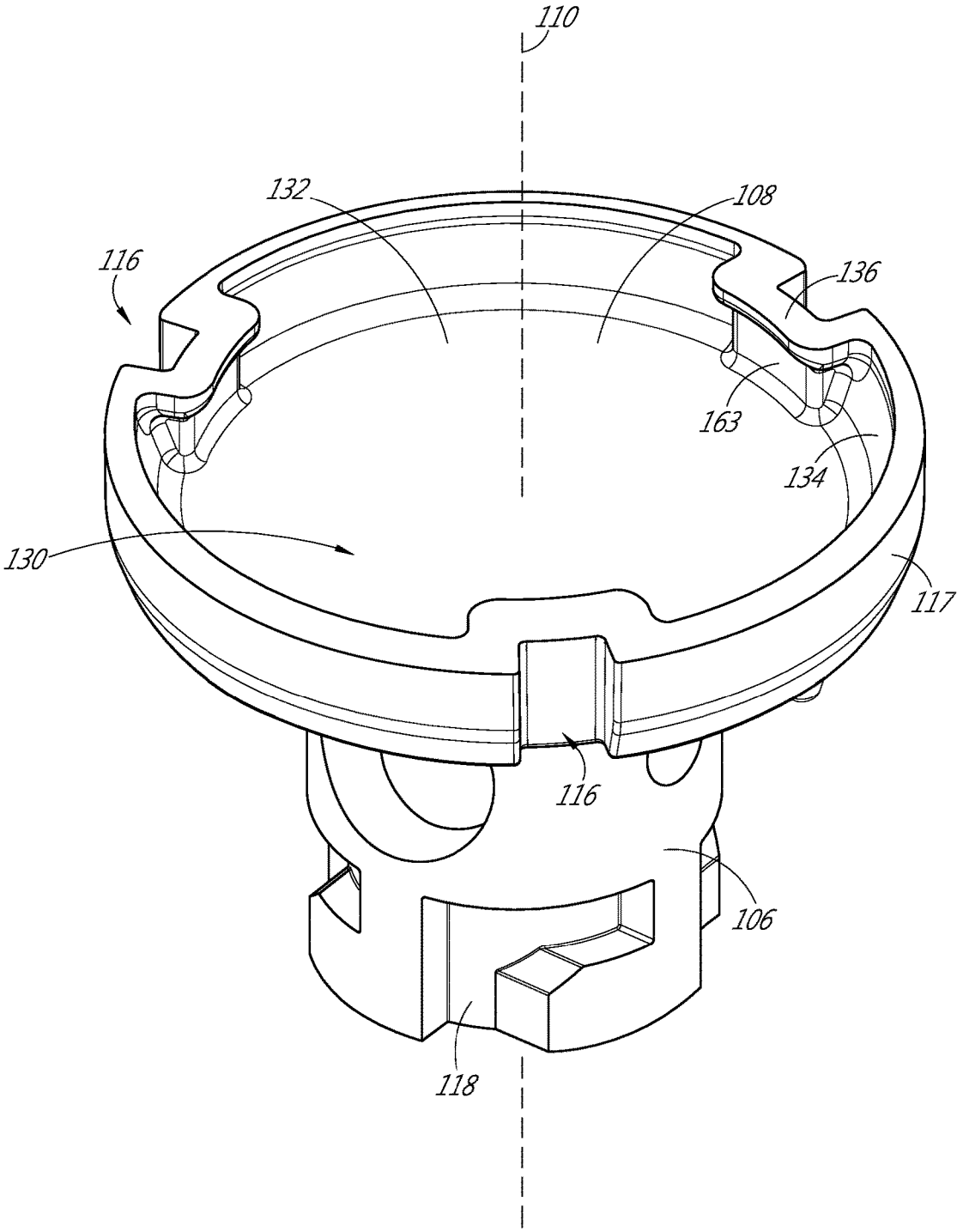
FIG. 14 illustrates a top isometric view of an embodiment of a head and a plaster device.

FIG. 14 illustrates a top isometric view of an embodiment of the head 106 and the plaster attachment device 108. The head 106 can have a jet opening or orifice 112 as discussed herein. The plaster attachment device 108 can have engagement mechanisms 140 (e.g., knobs, bosses, and/or protrusions) that mate with internal mechanisms of the waterjet apparatus 102 to function as discussed herein (e.g., reciprocate along the central axis 110 and rotate about the central axis 110 upon delivery of pressurized water). The plaster attachment device 108 can have a plaster opening 130 including a bottom surface 132, a sidewall 134, and/or flanges 136 as discussed herein.

As illustrated in FIG. 14, the plaster opening 130 can be maximized relative to the circumference about the central axis 110 of the plaster attachment device 108. The surface area, radius, and/or volume of the plaster opening 130 can be expanded radially outward from the central axis 110. The radius of the plaster opening 130 can be extended from the central axis 110 such that a portion of the sidewall 134 extends into the plaster opening 130 accommodate the slots 116 positioned at a periphery 117 of the plaster device 108 as discussed herein. The radius of the plaster opening 130 can be extended from the central axis 110 such that an inside profile about the central axis 110 of the sidewall 134 accommodates the slots 116 via indentations 163 to maintain a desired or predetermined thickness of the sidewall 134 at the slots 116. Accordingly, the sidewall 134 can have a profile such that both the inner and outer surfaces of the sidewall 134 extends substantially along the central axis 110 to accommodate being flush with the surface finish 103 as discussed herein. The flanges 136 of retaining the plaster 107 can extend into the plaster opening 130 from the slots 116.

Figure 15:
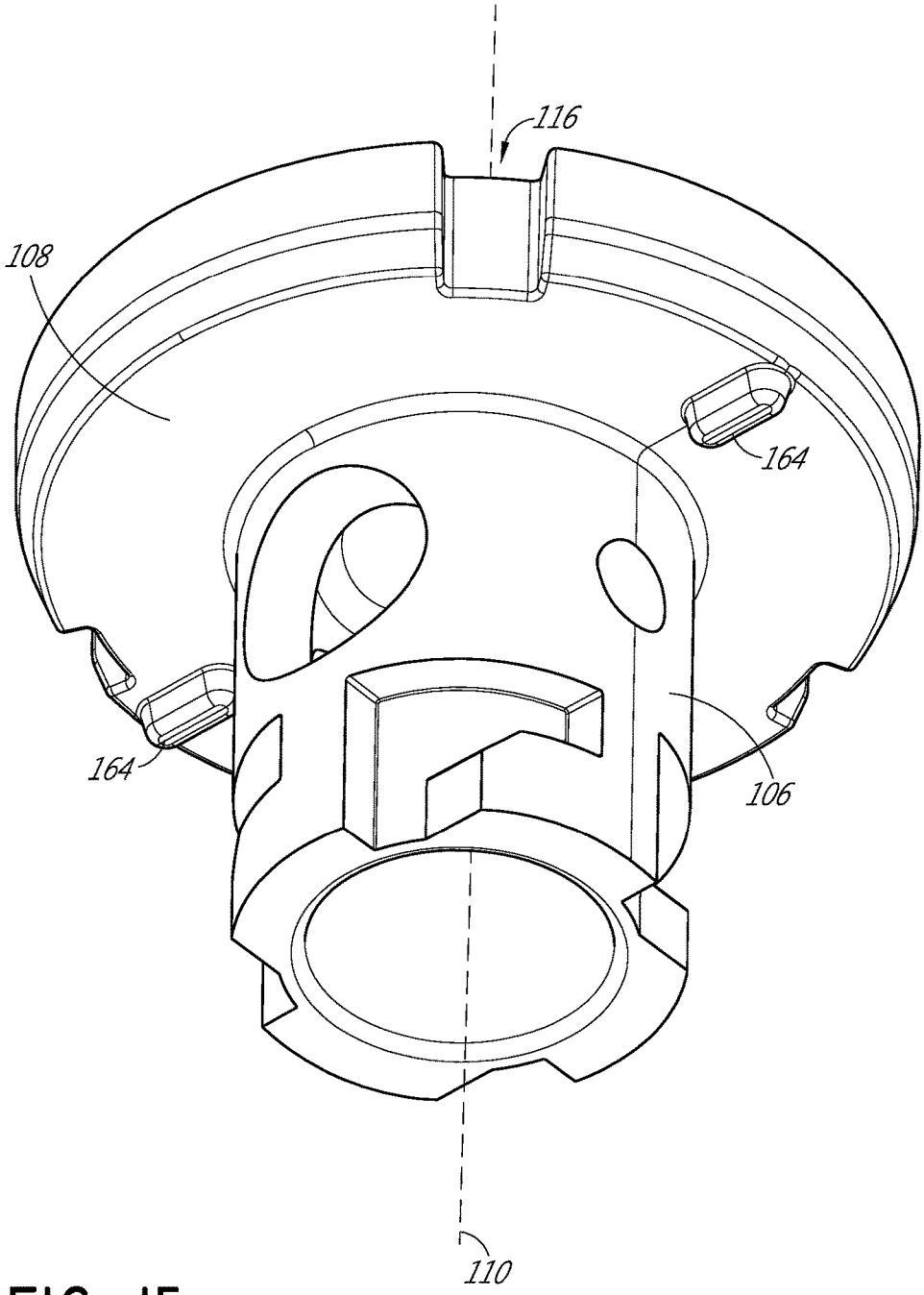
FIG. 15 illustrates a bottom isometric view of an embodiment of a head and a plaster device.

FIG. 15 illustrates a bottom isometric view of an embodiment of the head 106 and the plaster attachment device 108. The plaster attachment device 108 can have one or more protrusions or bosses 164 extending or protruding downwards along the central axis 110. The protrusions 164 can engage and/or meet with cutouts 166 as discussed herein.

Figure 16:
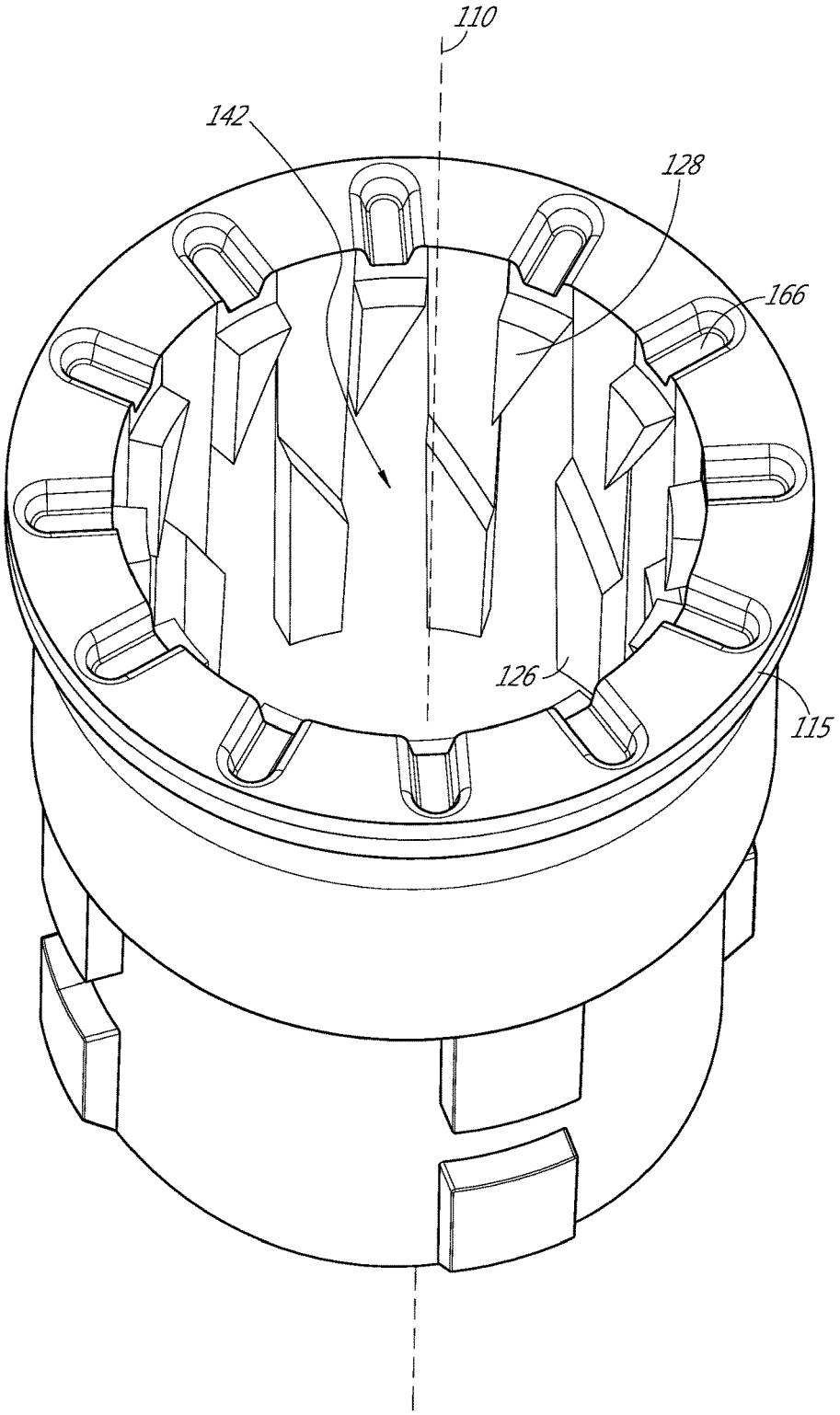
FIG. 16 illustrates a top isometric view of an embodiment of a housing.

FIG. 16 illustrates a top isometric view of an embodiment of the housing 104. The housing 104 can have same and/or similar characteristics as discussed herein or other embodiments of the housing 104, such as for example, lower ridges 126 and upper ridges 128 as discussed herein in reference to FIG. 7. The housing 104 can have housing cutouts, grooves, or slots 166 in a top surface of the housing 104. The cutouts 166 can be distributed evenly about the central axis 110 at, near, or proximate to the periphery 115 of the housing 104.

The cutouts 166 can be indentations in a top surface of the housing 104 (e.g., uppermost surface of the housing 104 along the central axis 110 in the direction 111). The cutouts 166 can be sized and/or shaped to engage and/or mate with the protrusions 164 as discussed herein and reference to FIG. 15. The cutouts 166 can be distributed about the central axis 110 similarly as discussed herein for the slots 114 of the housing 104. Accordingly, as the head 106 rotates about the central axis 110 as discussed herein, the protrusions 164 can align with the cutouts 166 when the head 106 and plaster device 108 is in the down position similar to how the slots 114, 116 align after reciprocating and rotating.

Figure 17:
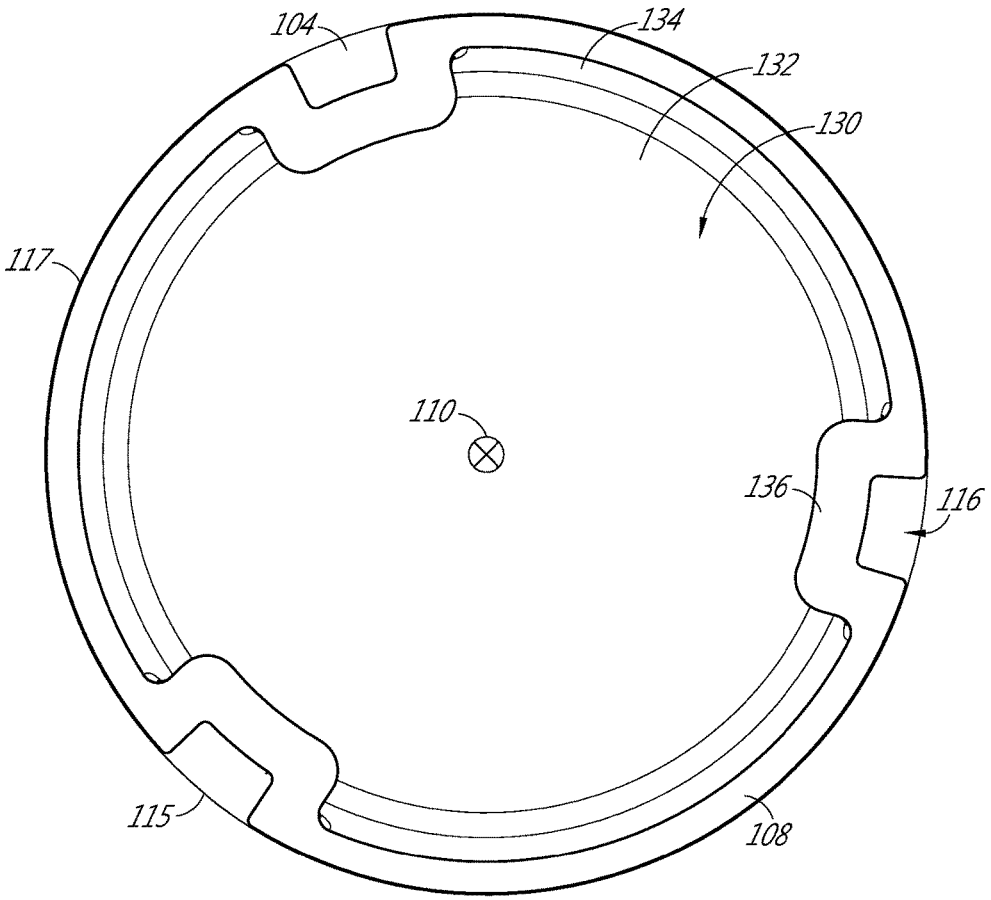
FIG. 17 illustrates a top view of an embodiment of a housing and a plaster device.

FIG. 17 illustrates a top view of an embodiment of the housing 104 and the plaster attachment device 108. The periphery 117 of the plaster attachment device 108 can extend out to the periphery 115 of the housing 104 along the central axis 110 to maximize the surface area of the plaster 107 in the plaster device 108. The housing 104 may not have slots 114 and/or any slots 114 of the housing 104 may not align with the slots 116 of the plaster device 108. In some embodiments, the maintenance tool may engage the slots 116 of the plaster device 108 to remove the housing 104, head 106, plaster device 108, and/or tube 120. For example, upon rotation of the plaster device 108 via the slots 116, the plaster attachment device 108 may rotate the housing 104 via, for example, the engagement of the protrusions 164 and cutouts 166 as discussed herein. Further, the housing 104 can be rotated via the engagement of the indentations 118 of the head 106 and the projections 122 of the tube 120. The housing 104 may be rotated by the engagement between the housing 104 and the tube 120.

Figure 18:
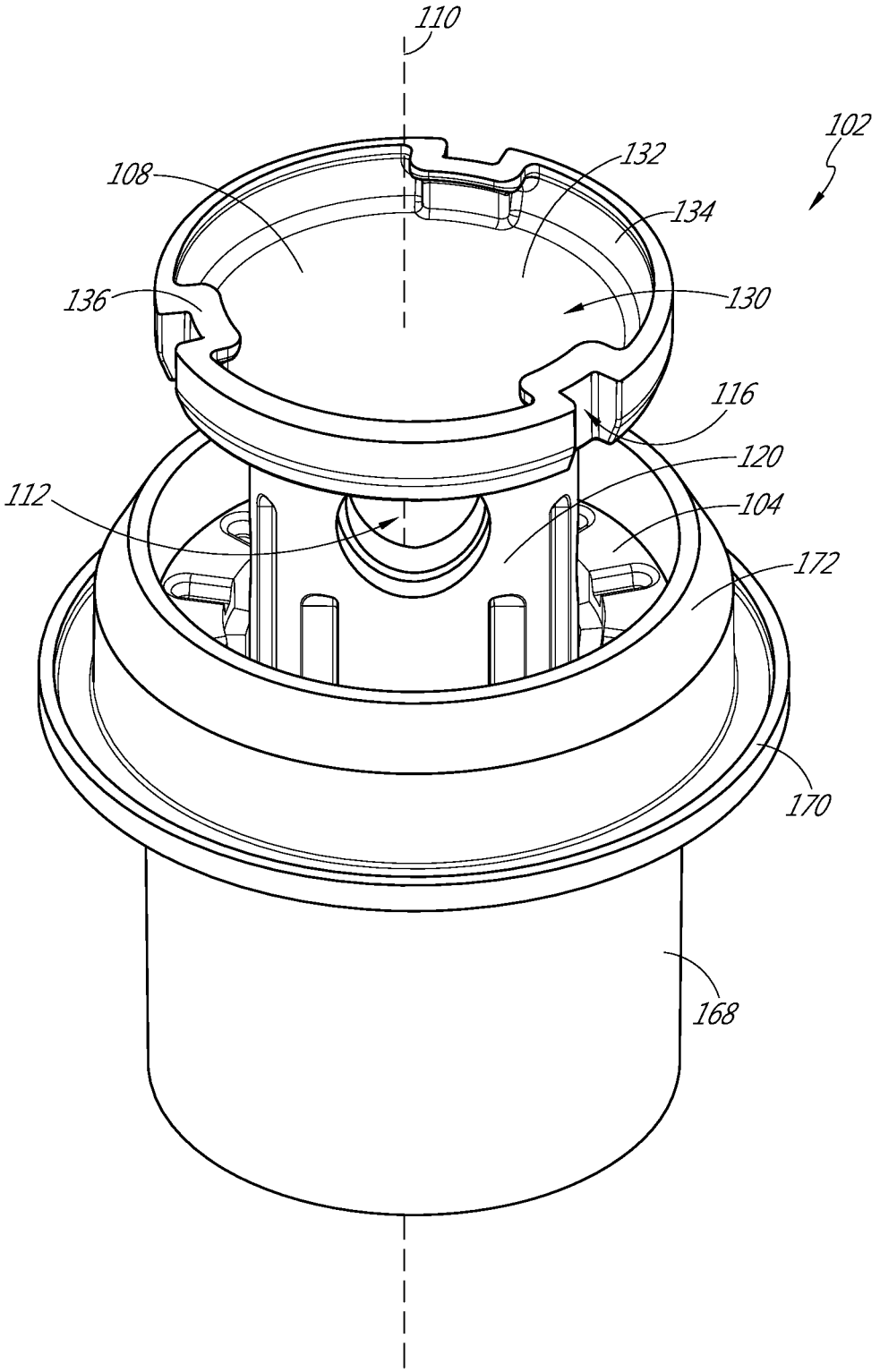
FIG. 18 illustrates a top isometric view of an embodiment of a waterjet apparatus.

FIG. 18 illustrates a top isometric view of an embodiment of the waterjet apparatus 102. As illustrated in FIG. 18, the plaster attachment device 108 can be engaged with the tube 120 via the head 106. The tube 120 can be engaged with the housing 104 via any suitable engagement mechanisms such as protrusions and indentations as discussed herein, including any other suitable tight fit and/or rotation engagement mechanisms such that the housing 104 and the tube 120 can be disengaged when desired for example with a maintenance tool. The housing 104 can be engaged with a sleeve 168 via any suitable engagement mechanisms such as protrusions and indentations as discussed herein, including any other suitable tight fit and/or rotation engagement mechanisms.

The sleeve 168 can engage, made, and/or connect with the wall of the pool and/or spa. For example, the wall of the pool and/or spark may be a cementitious or otherwise curable material, such as gunnite, that is poured around the sleeve 168. Upon the cementitious material curing, the sleeve 168 can be securely fixed within the wall of the pool and/or spa. Accordingly, the other components of the waterjet apparatus 102 can be securely engaged and/or physically fixed when engaged to the wall of the pool and/or spa via the sleeve 168 as long as, for example, the housing 104 and the sleeve 168 are engaged as discussed herein. The sleeve 168 can have a water retainer 170. The water retainer can be a gutter like structure that pulls water at a certain point along the central axis 110 such that water from the pool and/or spa does not proceed into the wall of the pool and/or spa beyond the waterjet apparatus 102.

As illustrated in FIG. 18, the housing 104 and/or sleeve 168 can engage, mate, and/or engage with a riser ring 172. As discussed herein, the plaster attachment device 108 can be designed such that a top surface (e.g., uppermost surface of the plaster device 108 along the central axis 110 in the direction 111) and plaster 107 are substantially flush with the surface finish 103 of the pool and/or spa. To achieve such a design, the internal mechanisms of the waterjet apparatus (e.g., housing 104, head 106, tube 120) may be shortened or have a smaller length along the central axis 110 to accommodate a depth of the plaster opening 130 as discussed herein.

The flush design of the waterjet apparatus 102 can be accommodated in existing sleeves 168 that may already be permanently fixed in existing walls of pools and/or spas. Rather than demolishing a part of the wall of the pool and/or spa to extract the existing sleeve 168, the internal mechanisms of the waterjet apparatus 102 can be shortened to accommodate a depth of the plaster opening 130. In some embodiments, the internal mechanisms may not be shortened enough to accommodate an entire depth of the plaster opening 132 (e.g., along the central axis 110) such that a top surface of the plaster attachment device 108 may be above a top surface of the sleeve 168 (e.g., uppermost surface of the sleeve 168 along the central axis 110). In addition or in lieu of shortening the internal mechanisms of the waterjet apparatus 102, a riser ring 172 can be provided to engage, mate, and/or engage the housing 104 and/or sleeve 168 such that a top surface of the plaster attachment device 108 is substantially flush with a top surface of the riser ring 172 as illustrated in FIG. 19 (e.g., uppermost surfaces of the plaster device 108 and riser ring 172 along the central axis 110 in the direction 111).

Figure 19:
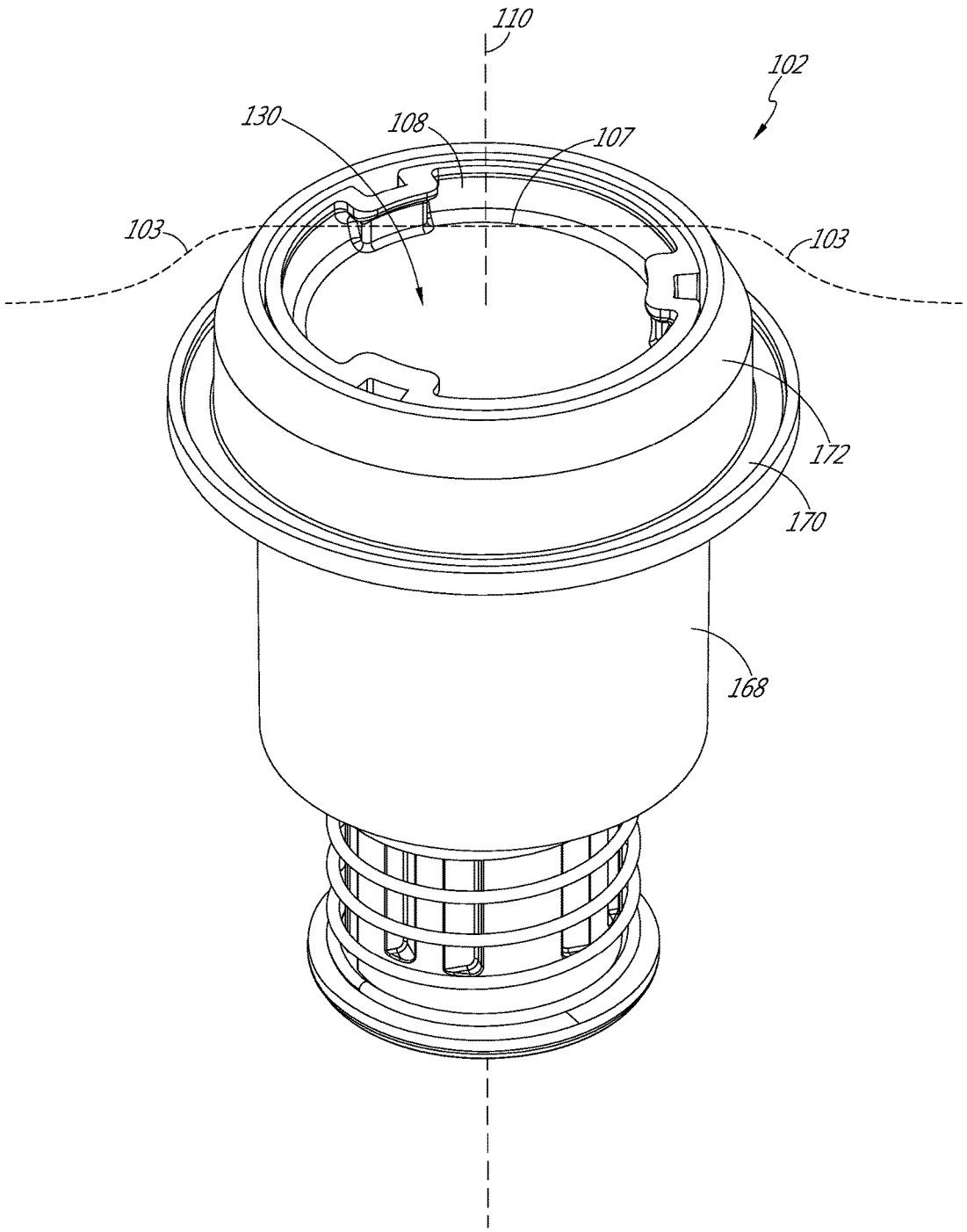
FIG. 19 illustrates a top isometric view of an embodiment of a waterjet apparatus relative to a surface finish.

FIG. 19 illustrates a top isometric view of an embodiment of the waterjet apparatus 102 relative to the surface finish 103. As discussed herein, the sleeve 168 may be an existing sleeve used with a conventional cleaning head. Upon installation of the waterjet apparatus 102 with a plaster attachment device 108, a riser ring 172 may be provided to house and/or circumscribe the plaster attachment device 108 about the central axis 110 such that the top surfaces of the waterjet apparatus are substantially flush.

As illustrated in FIG. 19, the material of the surface finish 103 may be built up or sloped up toward the top surface of the riser ring 172. For example, an existing surface finish 103 may be substantially at a level of the top surface of the existing sleeve 168 relative to the central axis 110. Upon installation of the waterjet apparatus 102 with the plaster attachment device 108 and a riser ring 172, the surface finish 103 of the wall containing the artificial body of water may be gradually built up or sloped such that the surface finish 103 comes up against the riser ring 172 substantially flush with a top surface of the riser ring 172. Plaster 107 can be included in the plaster attachment device 108 that is substantially flush with the top surfaces of the plaster attachment device 108 and riser ring 172 as well as the surface finish 103 as discussed herein. While the slope of the surface finish 103 leading up to the waterjet apparatus 102 may be as illustrated in FIG. 19, slope of the surface finish 103 may be more or less depending on desired flushness of the plaster 107 with the surface finish 103 as discussed herein. For example, the plaster 103 may be built up over many radiuses away from the central axis 110 such that the slope of the surface with finish 103 leading up to the top surfaces of the waterjet apparatus and/or plaster 107 is substantially unnoticeable.

Figure 20:
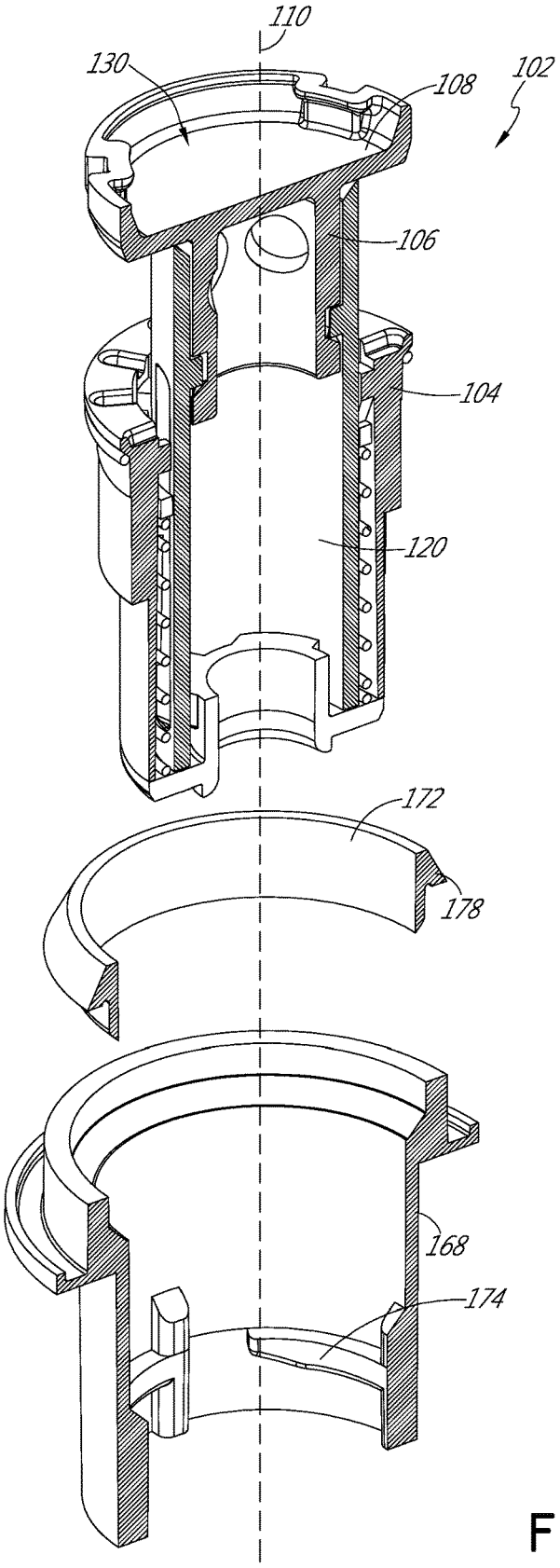
FIG. 20 illustrates an exploded top isometric view of an embodiment of a waterjet apparatus with a riser ring.
Figure 21:
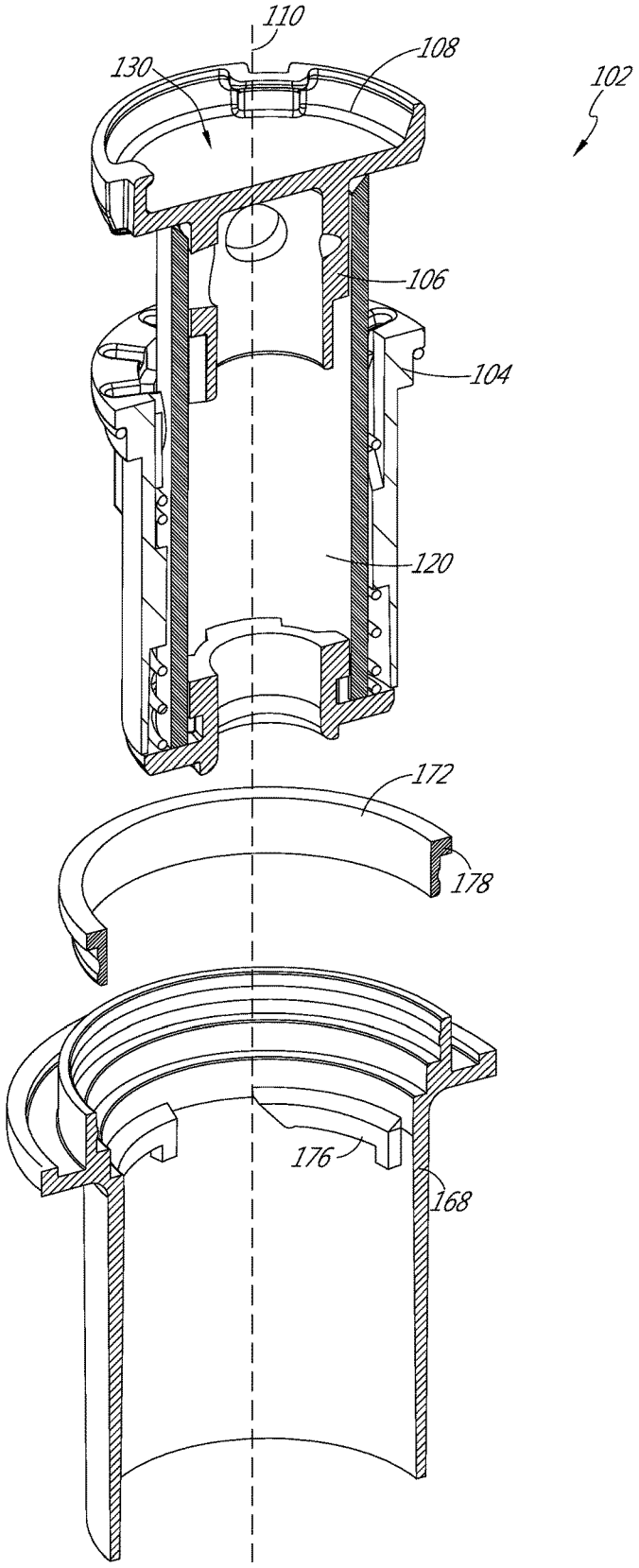
FIG. 21 illustrates an exploded top isometric view of an embodiment of a waterjet apparatus with a riser ring.
Figure 22:
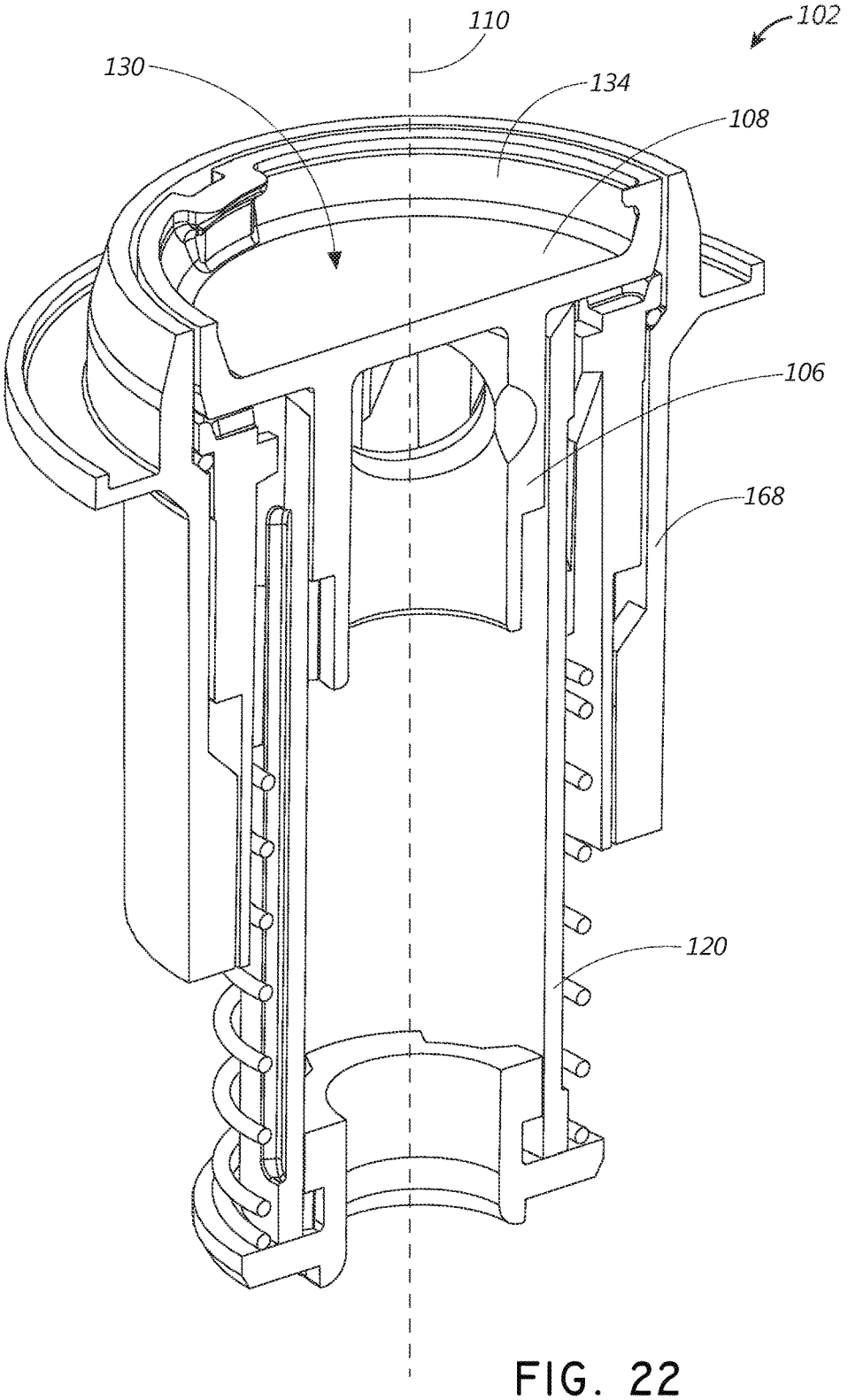
FIG. 22 illustrates a cross-sectional top isometric view of an embodiment of a waterjet apparatus.
Figure 23:
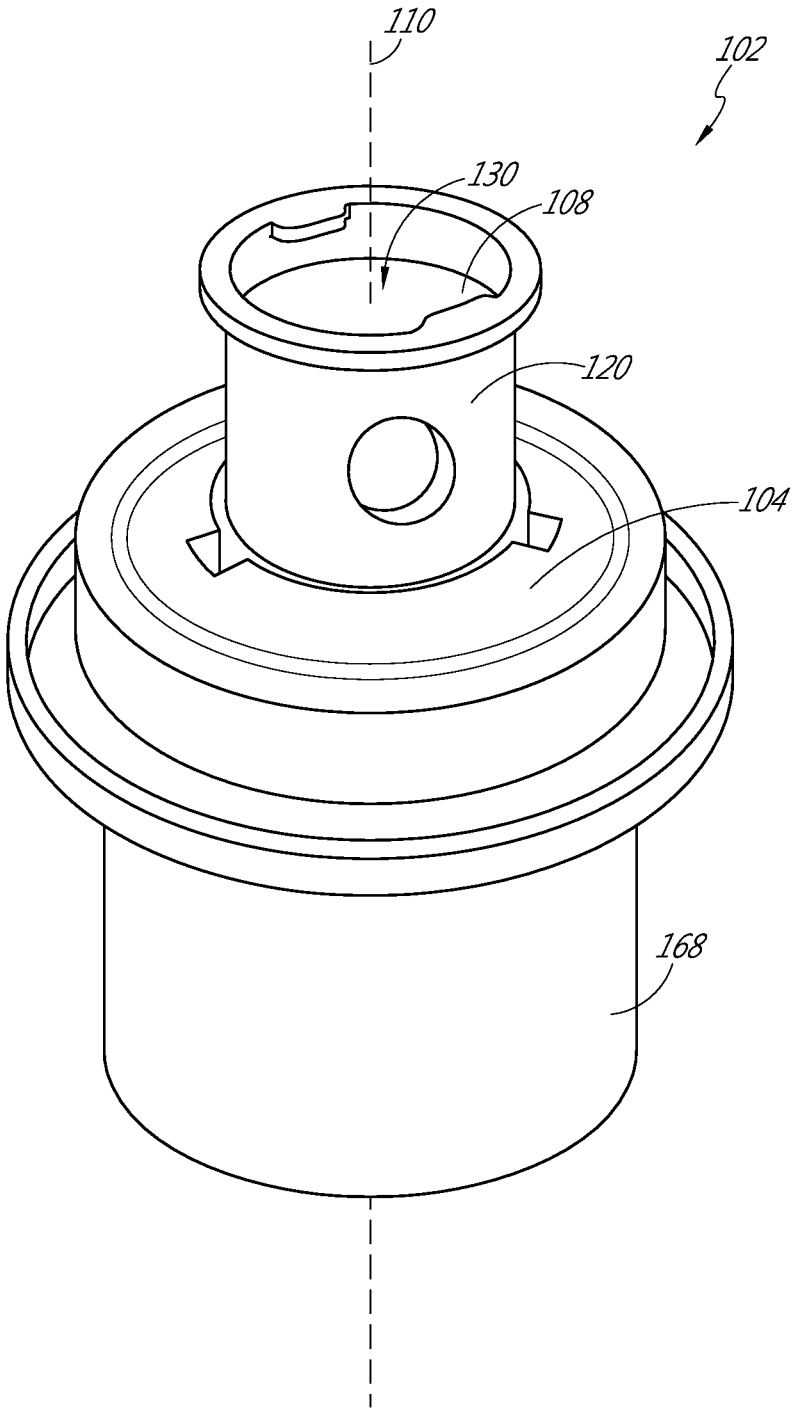
FIG. 23 illustrates a top view of an embodiment of a waterjet apparatus.

FIGS. 20 and 21 illustrate exploded top isometric views of embodiments of waterjet apparatuses 102 with riser rings 172. As illustrated in FIGS. 10 and 22, various riser rings 172 may be used depending on the desired and/or predetermined rise relative to the sleeve 168. For example, various existing sleeves 168 may be embedded in the surface finish 103 of the walls containing artificial bodies of water. The various existing sleeves 168 may have different heights along the central axis 110. Accordingly, different size riser rings 172 can be used to accommodate a desired depth of the plaster opening 130.

With continued reference to FIGS. 20 and 21, the riser rings 172 can have various features such as protrusions and/or D dense to engage the various sleeves 168 as desired. For example, FIG. 10 illustrates a sleeve 168 that has protrusions 174 near or proximate to a lower portion of the sleeve 168. The top portion of the sleeve 168 shown in FIG. 20 may have a relatively smooth inner wall such that an outer surface of the corresponding riser ring 172 may be substantially smooth. FIG. 21 illustrates a sleeve 168 that has protrusions 176 near a top portion of the sleeve 168. The top portion of the sleeve 168 shown in FIG. 21 may have protrusions and/or detents (e.g., tracks) such that an outer surface of the corresponding riser ring 172 may have corresponding intrusions and/or detents to engage the sleeve 168. As illustrated in FIGS. 20 and 21, the riser rings 172 can have flanges 178 that rest on predetermined (e.g., top) surfaces of the sleeves 168. Accordingly, an existing sleeve 168 positioned in a wall of a pool and/or spa may engage, connect, and/or mate with a riser ring 172 in a desired and/or predetermined position such that a surface finish 103 can be built up to be substantially flush with surfaces of the waterjet apparatus 102.

FIG. 22 illustrates a cross-sectional top isometric view of an embodiment of the waterjet apparatus 102. In some embodiments, a sleeve 168 can be provided without a riser ring 172. For example, either when a pool and/or spa is being constructed or a part of the wall having a surface finish 103 is demolished to extract an existing sleeve 168, and a new sleeve 168 without a riser ring 172 can be installed.

As illustrated in FIG. 22, top surfaces on the plaster device 108 can be substantially flush with the top surfaces of the sleeve 168 (e.g., uppermost surfaces of the plaster device 108 and the sleeve 168 are substantially flush). Similar features of a riser ring 172 as discussed herein can be incorporated into the sleeve 168 that is being installed into the wall having the surface finish 103. The sleeve 168 can be formed from a same or monolithic piece of material (e.g., injection molded).

When installing sleeve 168 in the wall having the surface finish 103, the sleeve 168 can be positioned such that a top surface of the sleeve 168 is substantially flush with the surface finish 103. Accordingly, upon addition of the plaster to the plaster opening 130 of the plaster device 108, the surface finish 103 and plaster 107 can be substantially flush.

Figure 25:
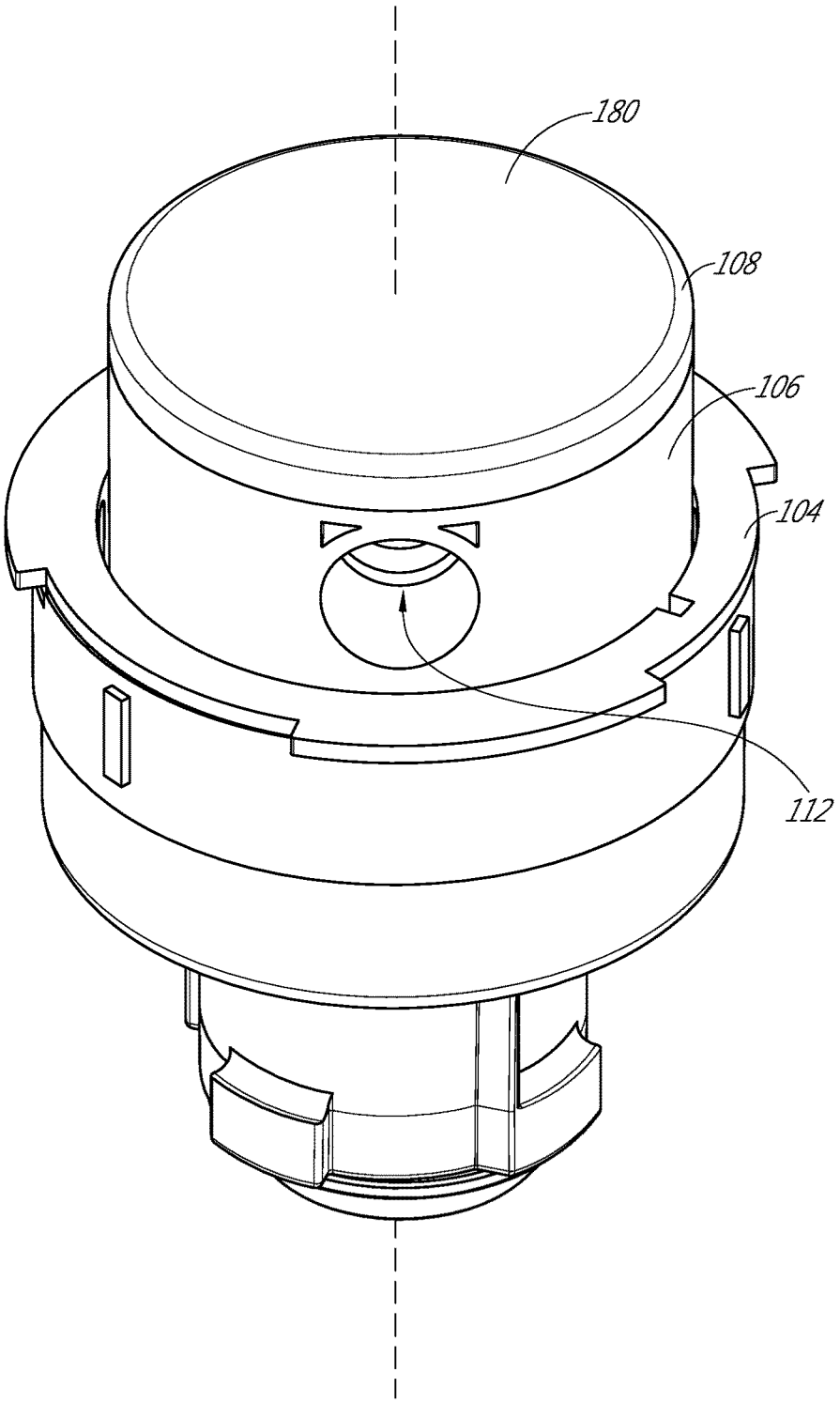
FIG. 25 illustrates a top isometric view of an embodiment of a waterjet apparatus in an up position.

FIG. 25 illustrates a top view of an embodiment of the waterjet apparatus 102. FIG. 25 shows a plaster attachment device 108 having a radius substantially equal to a radius of the sleeve 168. Accordingly, while more plastic without plaster may be visible against the surface finish 103, a relatively smaller plaster attachment device 108 can be integrated into existing cleaning heads with, for example, corresponding shortening of the internal components of the cleaning head as discussed herein to accommodate the plaster attachment device 108. For example, the housing 104 may be similar to a housing that is supplied with a standard in-floor cleaning heads. A plaster attachment device 108 having a radius that can fit within an opening of substantially the same radius as that of a standard housing can be provided to allow for some plaster 107 and therefore camouflaging as discussed herein of a conventional cleaning head.

Figure 24:
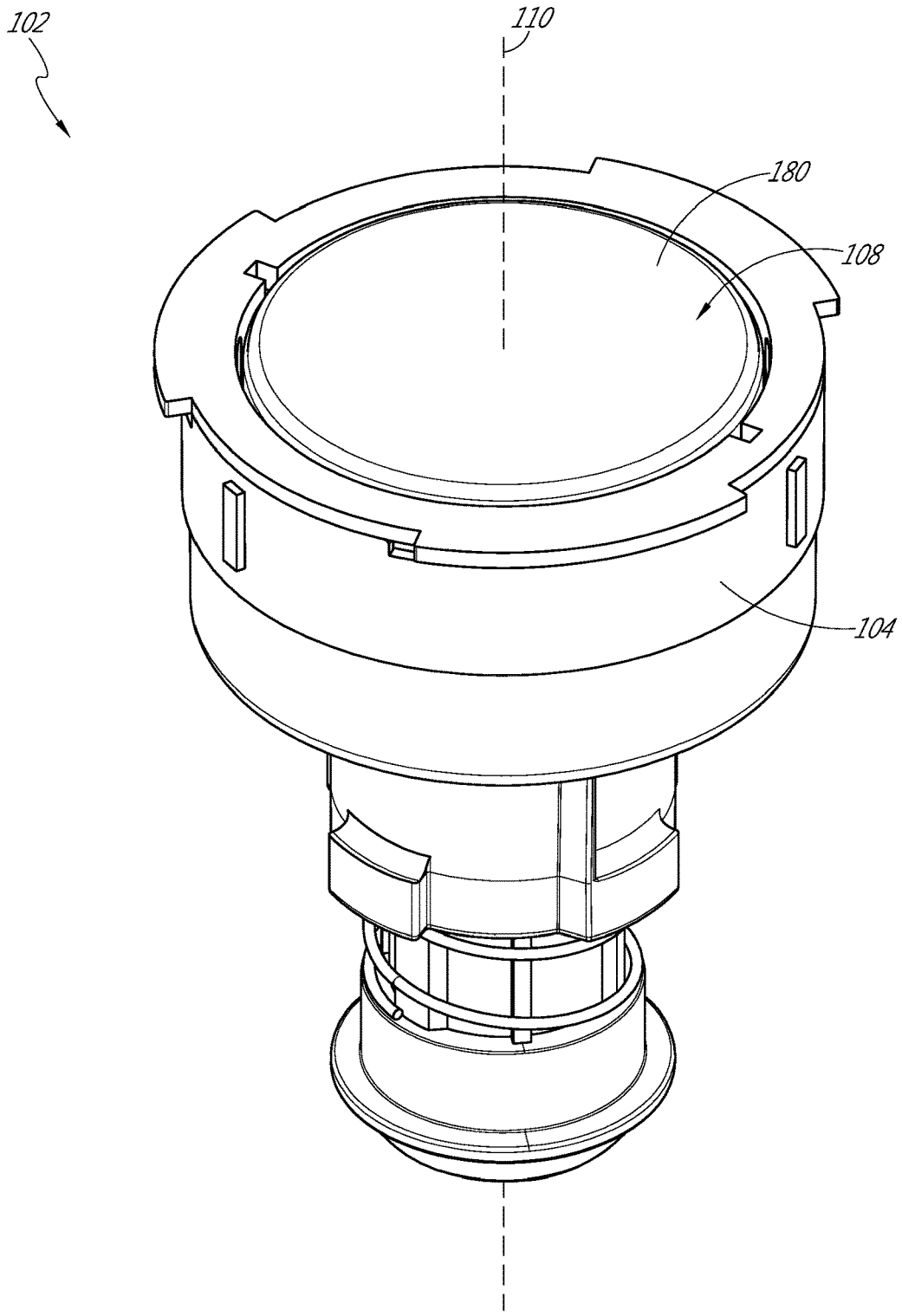
FIG. 24 is a top isometric view of an embodiment of a waterjet apparatus in a down position.
Figure 26:
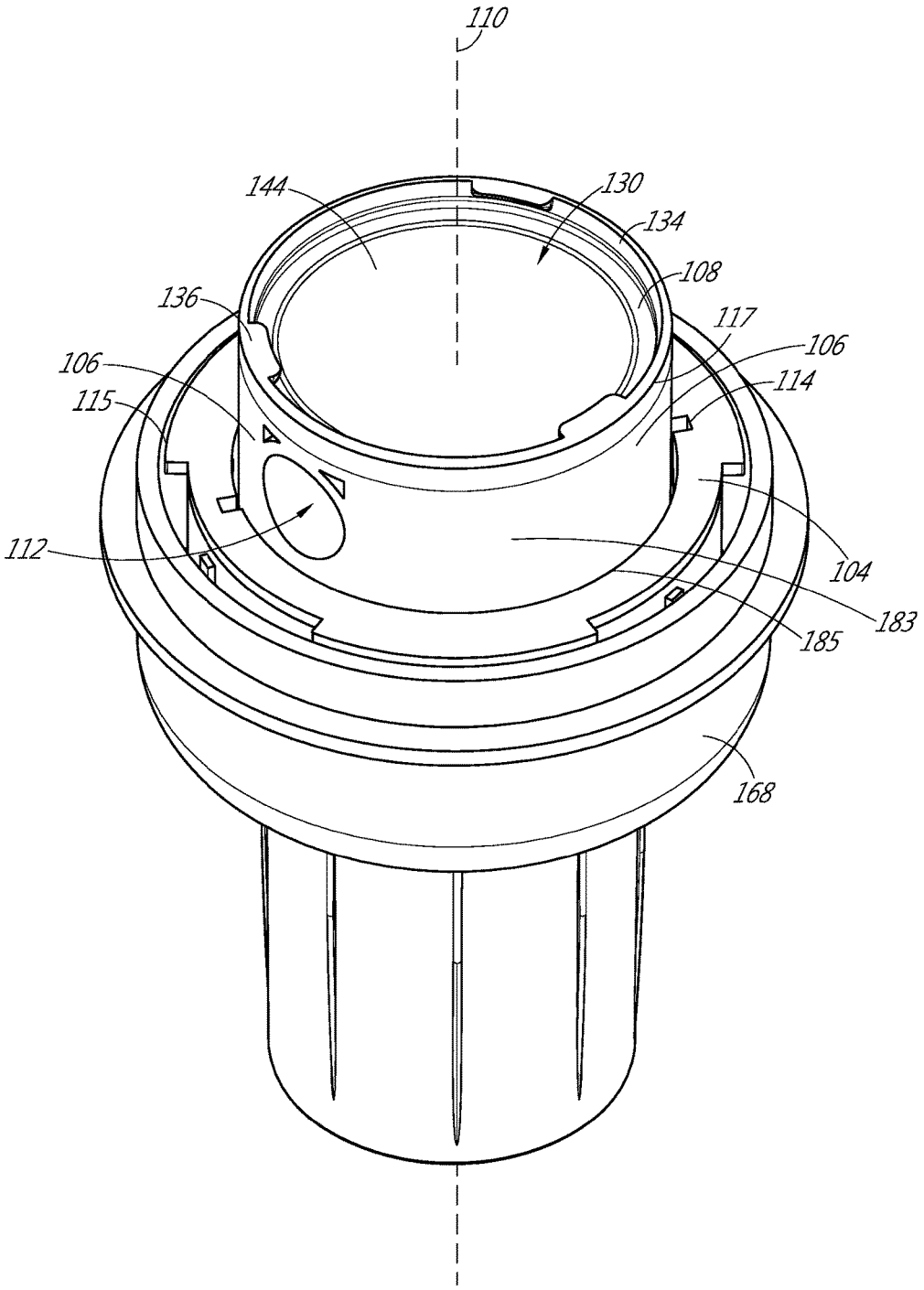
FIG. 26 illustrates a top isometric view of an embodiment of a waterjet apparatus in an up position.
Figure 27:
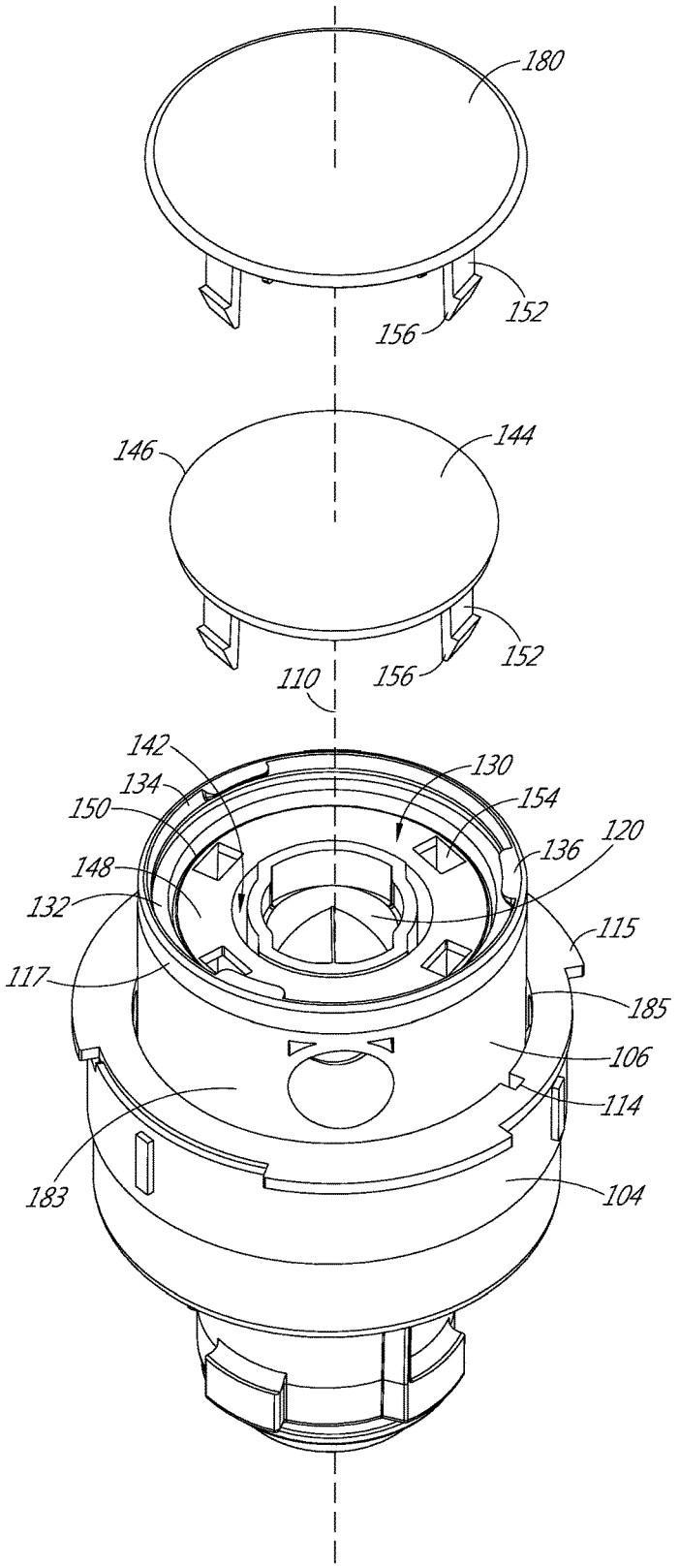
FIG. 27 illustrates an exploded top isometric view of an embodiment of a waterjet apparatus with a recessed base and a cap or lid.
Figure 28:
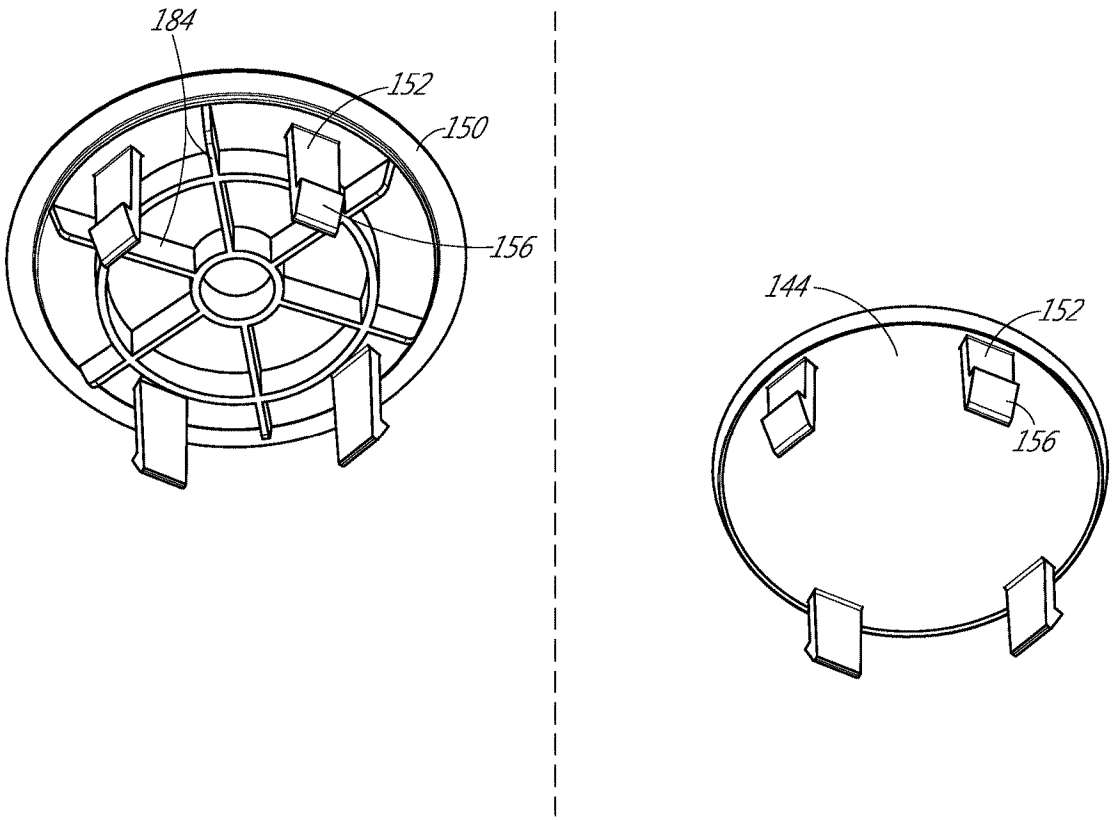
FIG. 28 illustrates a bottom isometric view of a cover and a cap.
Figure 29:
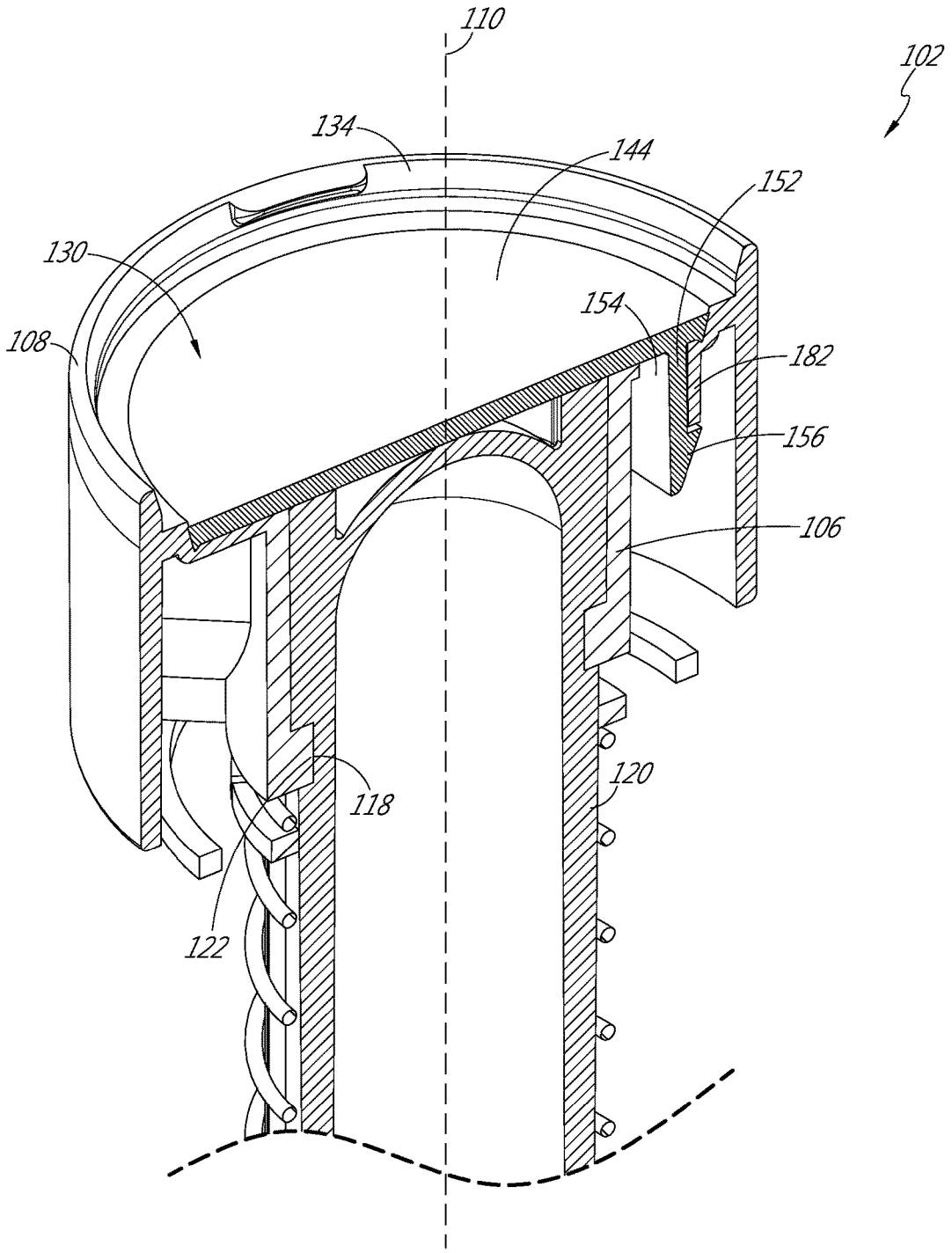
FIG. 29 illustrates a top isometric cross-sectional view of an embodiment of a waterjet apparatus.

FIG. 24 is a top isometric view of an embodiment of the waterjet apparatus 102 in a down position. FIG. 25 illustrates a top isometric view of an embodiment of the waterjet apparatus 102 in an up position. FIG. 26 illustrates a top isometric view of an embodiment of the waterjet apparatus 102 in an up position. FIG. 27 illustrates an exploded top isometric view of an embodiment of the waterjet apparatus 102 with the recessed base 144 and the cap or lid 180. FIG. 28 illustrates a bottom isometric view of the recessed base 144 and the cap 180. FIG. 29 illustrates a top isometric cross-sectional view of an embodiment of the waterjet apparatus 102.

In some embodiments, waterjet apparatus 102 can be provided as a kit. The waterjet apparatus 102 can be provided with a recessed base 144 as discussed herein. The waterjet apparatus 102 can be provided alternatively or in addition with a cap 180. The cap 180 can have projections 152 and extending portions 156. The projections 152 and/or extending portions 156 of the cap 180 can engage cutouts 154 of the plaster device 108 similarly as discussed herein for the recessed base 144. For example, FIG. 29 shows a projection 152 of the recessed base 144 extending through the cutout 154 to provide at least in part a bottom surface 132 of the plaster opening 130 as discussed herein. Upon insertion through the cutouts 154, the projections 152, in particular as illustrated, the extending portions 156 can engage a boss, projection, or protrusion 182 substantially to secure the recessed base 144 relative to the bottom surface 132 as discussed herein. As illustrated in FIG. 27, the plaster device 108 can have four cutouts 154. In some embodiments, the plaster device 108 can have 3, 5, 6 or more cutouts 154 as desired to securely engage the recessed base 144 and/or cap 180 as discussed herein. Other suitable mating connections can include interference fit mechanisms, snap fit mechanisms, and the like, which can include using male and female mating parts (e.g., tongue-and-groove corresponding parts as illustrated in FIG. 10).

As illustrated in FIGS. 26 and 27, the plaster attachment device 108 can have a periphery 117 that substantially aligns with a periphery 183 of the body 106. As the body 106 reciprocates relative to the housing 104 as discussed herein, the periphery 115 of the housing 104 can have a greater radius than the periphery 117. As illustrated in FIGS. 26 and 27, the slots 114 can be positioned on an inner periphery 185 of the housing 104. The slots 114 can radially extend outward from the inner periphery 185 and not connect with the out periphery 115. A radius of the periphery 117 can be less than the radius of the periphery 185, but the tow peripheries 117, 185 can correspond such that the head 106 reciprocates within the housing 104 (e.g. within the periphery 185) as discussed herein. Accordingly, the plaster attachment device 108 may not have slots 116 as discussed herein to accommodate a maintenance tool that is configured to engage with the slots 114 of the housing 104.

As illustrated in FIGS. 27 and 28, the plaster attachment device 108 can have a lip 148 circumscribing central opening 142 about the central axis 110 (e.g., a flange extending from the central openings 142) as discussed herein. The lip 148 can be defined by or have an outer perimeter or periphery 150 (e.g., sidewall) extending about the central axis 110. In some embodiments, the periphery 150 can be extended out or have a greater/longer radius from the central axis 110 relative to the periphery 150 as described for example in reference to FIG. 10. Accordingly, a greater radius of the periphery 150 can allow to move the cutouts 154 in the lip 148 further away from the central axis 110 (e.g., greater radius away from the central axis 110). Such an arrangement of the cutouts 154 can facilitate the function and engagement of a cap 180 as discussed herein.

As illustrated in FIGS. 24, 25, and 26, the cap 180 can be engaged with the plaster attachment device 108 such that a top surface of the cap 180 is substantially flush with a top surface of the housing 104. For example, the surface finish 103 may be substantially flush with a top surface of the housing 104 and/or sleeve 168 as discussed herein. By providing a recessed base 144 engaged with the plaster attachment device 108 at a substantially flush level, the top surface of the cap 180 can be substantially flush with the surface finish 103.

The cap 180 may be made of a plastic material that matches the plastic material of the housing 104 and/or sleeve 168. Accordingly, the cap 180 may be used with the plaster attachment device 108 where aesthetics of a conventional cleaning head are desired. For example, when using the waterjet apparatus 102 with the cap 180, plaster 107 is not added to the plaster device 108. The cap 180 can be used permanently or temporarily as desired (e.g., until the finalized surface finish 103 of the pool and/or spa is determined). A kit containing the waterjet apparatus 102 can be provided with a recessed base 144 and a cap 180. Depending on desired application, the plaster attachment device 108 can be engaged with either the recessed base 144 or the cap 180. If initially the plaster attachment device 108 is engaged with the cap 180, the cap 180 can be later removed and the recessed base 144 engaged to apply plaster 107 as discussed herein.

As illustrated in FIGS. 27 and 28, the cap 180 can have projections 152 and/or extending portions 156 that function and/or mate with cutouts 154 and/or bosses 182 as discussed herein. As illustrated in FIG. 28, the cap 180 can have supports 184 projecting from a bottom surface 186 of the cap 180. The supports 184 can be projections, a web of fins, or any other suitable structure to provide structural integrity to the cap 180 as discussed herein.

Because the cap 180 is covering and is over the plaster opening 130 when not filled with plaster 107, a support structure 184 may be provided to help maintain the structural integrity of the cap 180 when positioned in the plaster opening 130. For example, the support structure 184 may inhibit or substantially prevent the cap 180 from breaking or bending into the plaster opening 130 via, for example, the support structure 184 abutting the lip 148.

Figure 30A:
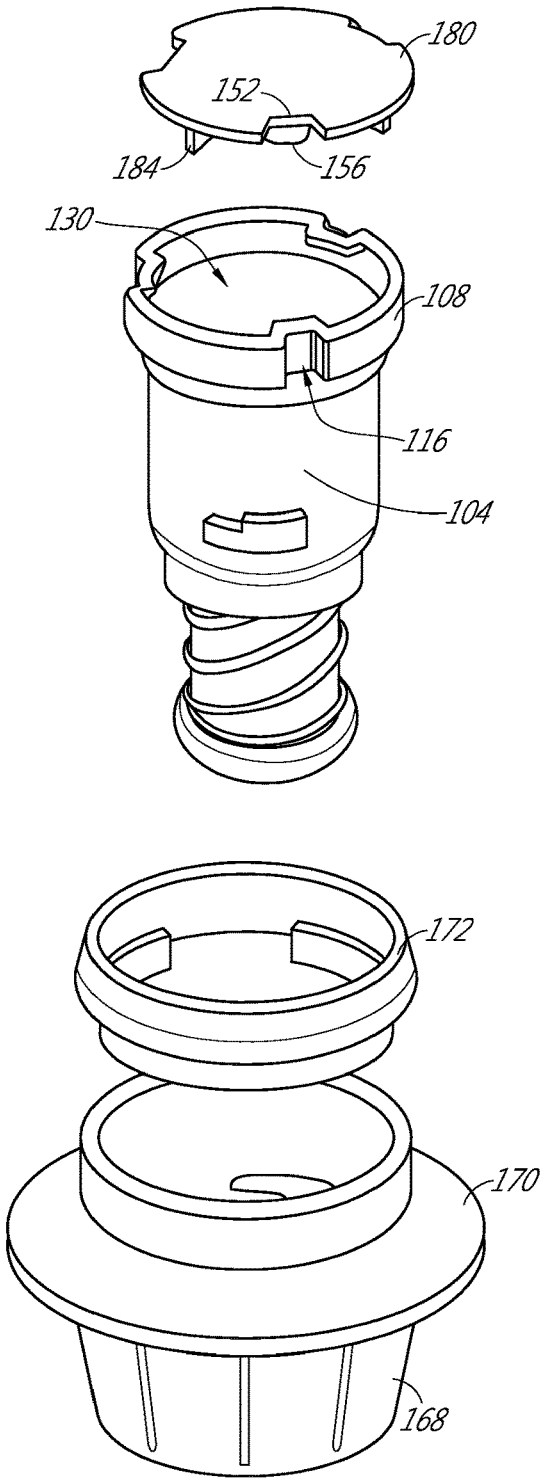
FIG. 30A illustrates a top isometric view of an embodiment of a waterjet apparatus.
Figure 30B:
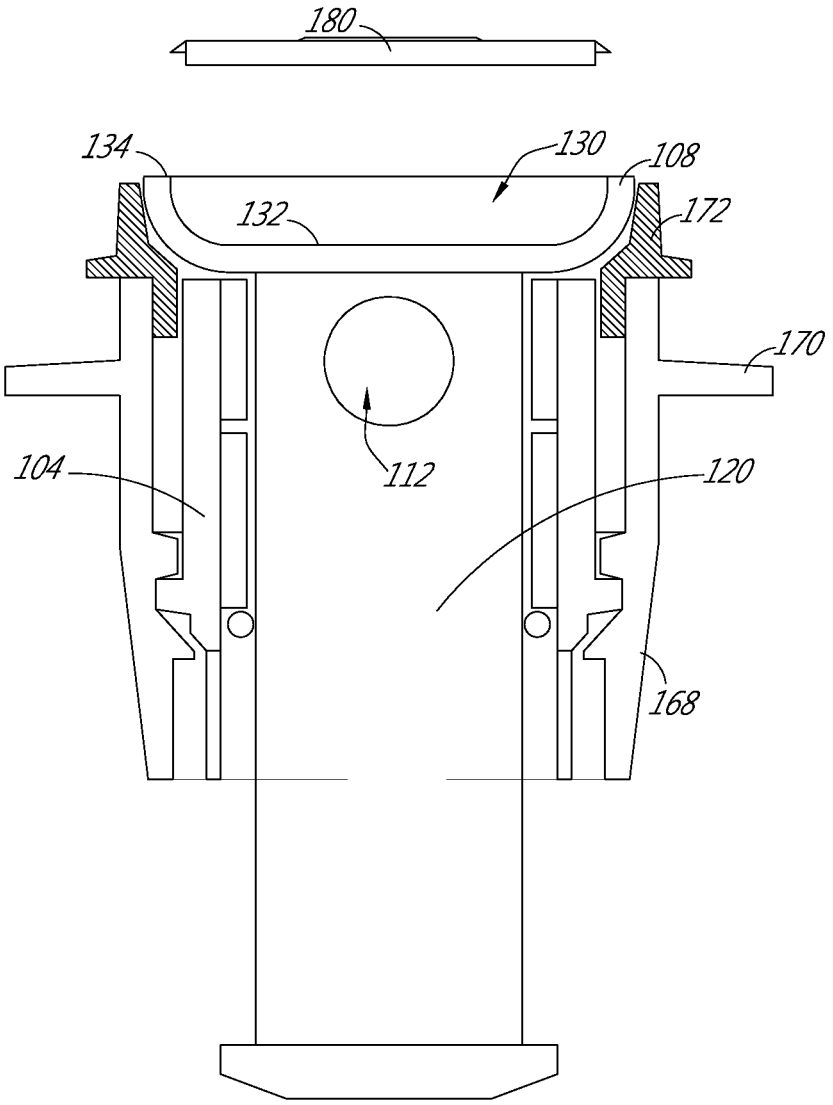
FIG. 30B illustrates a side and partial cross-sectional view of an embodiment of a waterjet apparatus.

FIG. 30A illustrates a top isometric view of an embodiment of the waterjet apparatus 102. FIG. 30B illustrates a side and partial cross-sectional view of an embodiment of the waterjet apparatus 102. The waterjet apparatus 102 illustrated in FIGS. 30A-B can have the various functionality and/or features as discussed herein for other embodiments of the waterjet apparatus 102. For example, the waterjet apparatus 102 can have a cap 180 that is configured to be substantially flush with other top surfaces of the waterjet apparatus 102 and correspondingly, substantially flush with the surface finish 103 as discussed herein.

As illustrated in FIG. 30A, the cap 180 can have projections 156 substantially at a periphery 183 of the cap 180. The projections 156 can be sized and shaped to engage, connect, and/or mate with the slots 116 positioned at the periphery 117 of the plaster device 108 as discussed herein. Accordingly, separate cutouts 154 to engage with a cap 180 may not be provided or necessary in some embodiments. The projections 152 can have extending portions 156 as discussed herein. The slots 116 can have corresponding portions (e.g. indentations, cutouts, bosses, protrusions, etc.) configured to engage, connect, and/or mate with the projections and/or extending portions 156 of the cap 180 to securely position the cap 180.

Figure 31A:
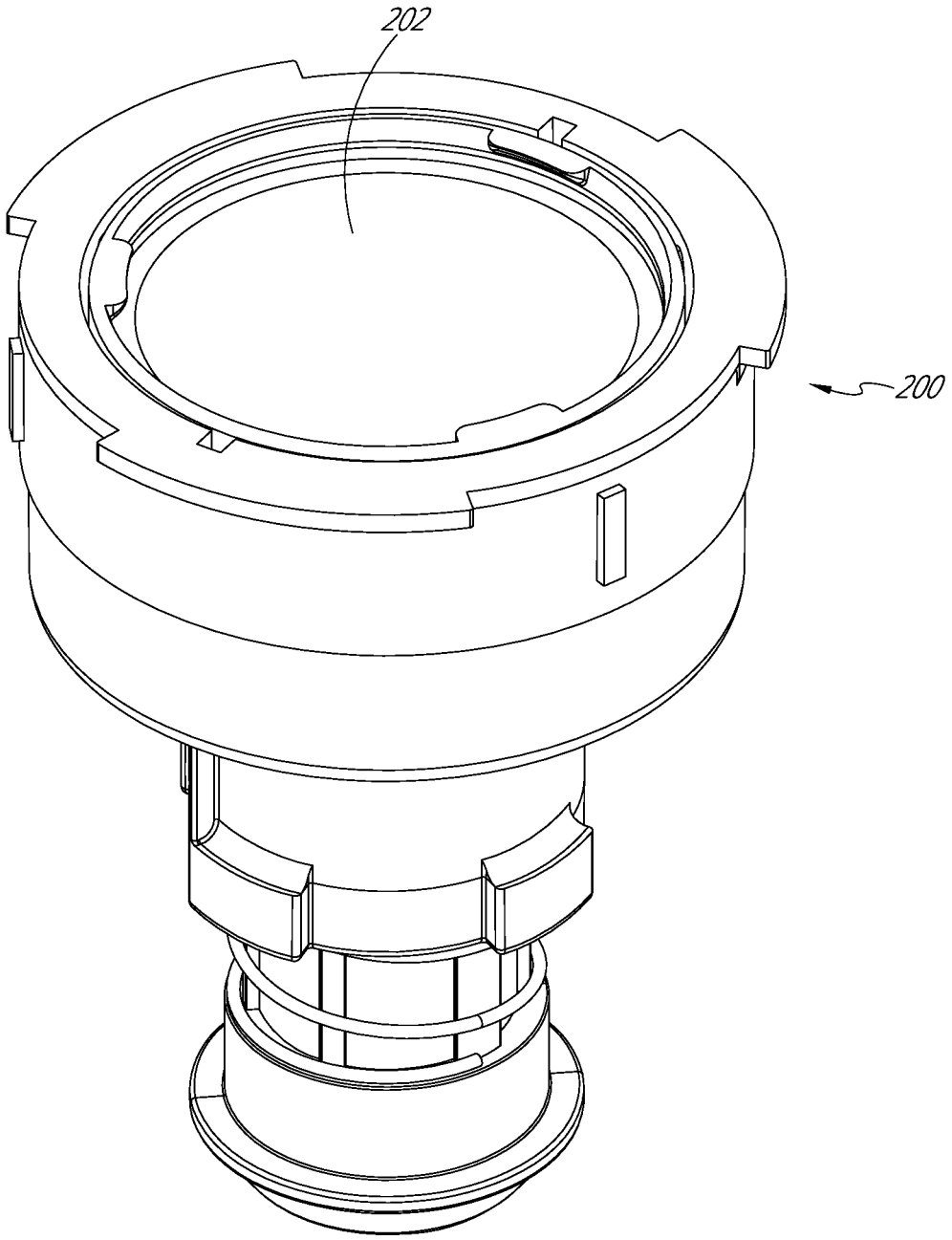
FIG. 31A illustrates a top isometric view of an embodiment of a waterjet apparatus.
Figure 31B:
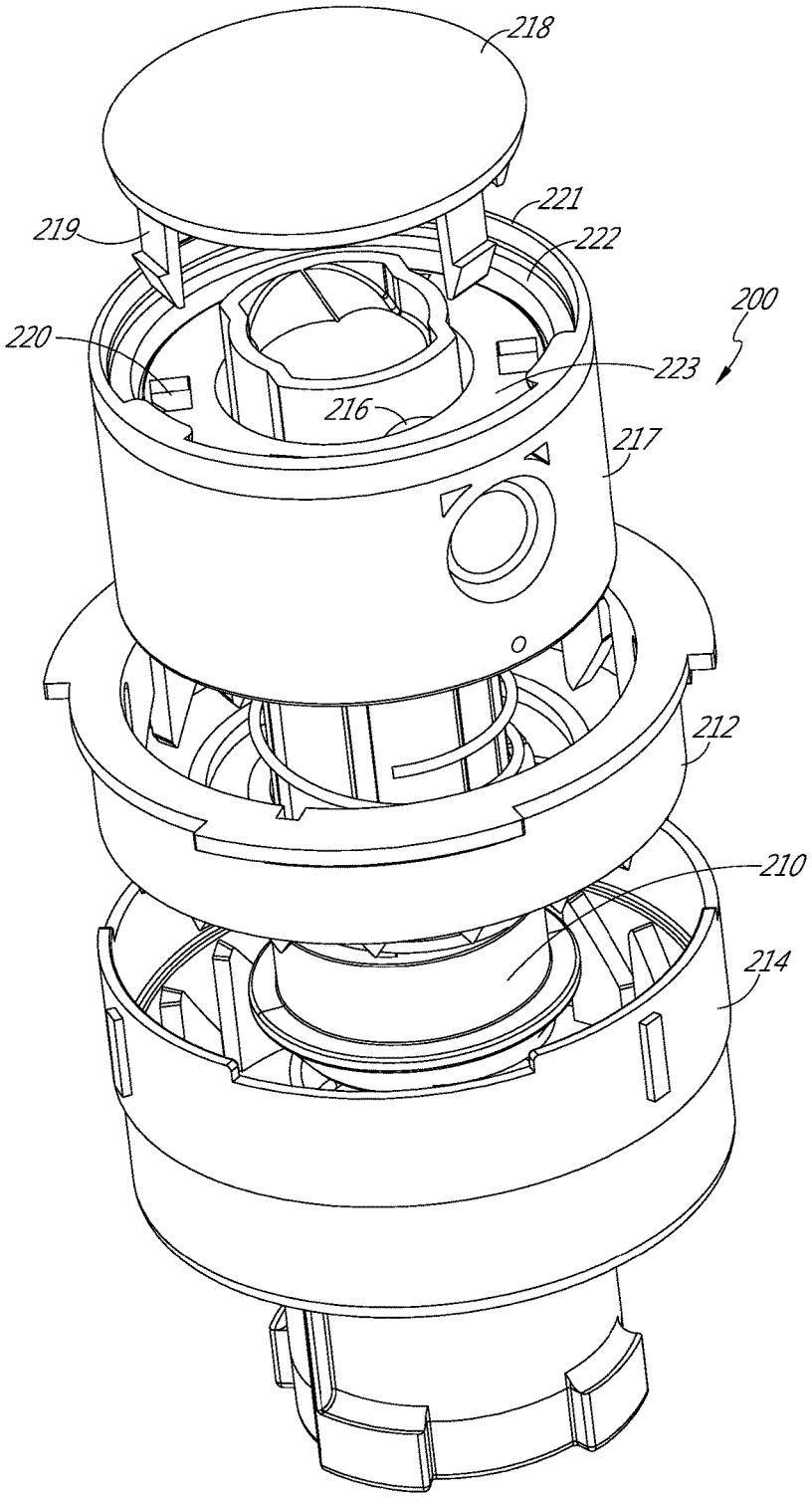
FIG. 31B illustrates an exploded top isometric view of the waterjet apparatus of FIG. 31A.

FIG. 31A illustrates a waterjet apparatus 200 of one embodiment, which can be used as part of a swimming pool in-floor cleaning system known in the art. Additional details on the workings of swimming pool in-floor cleaning systems can be found in U.S. Pat. No. 4,322,860 which is incorporated herein by reference. The apparatus 200 is configured with a moveable delivery head that extends upwardly when pressurized water is delivered through apparatus. The apparatus 200 further includes a recessed upper portion 202 for receiving and securing a plaster mixture. The plaster mixture can include plaster, pebbles, and other fragmentary materials mixed therein. FIG. 31B is an exploded view of the waterjet apparatus 200. The apparatus 200 has a hollow spring biased stem 210, an upper guide sleeve 212, and a lower guide sleeve 214. The stem 210 has a circular opening 216 disposed on an upper end and is connected to a moveable delivery head 217 in a manner such that up and down movement of the stem 210 will in turn move the delivery head. The moveable delivery head 217 has an annular upper surface 223 and a circumferential lip 221 extending upwardly from the periphery of the annular upper surface. An annular step 222 can also be disposed along circumferentially around the upper surface 223 between the upper surface 223 and the annular lip 221. The apparatus further includes a plate 218 having a plurality of snap-on clips 219 disposed along the periphery. The snap-on clips 219 are configured to mate with corresponding slots 220 formed on the upper surface 223 of the moveable delivery head 217. When the snap-on clips 219 of the plate 218 engage with the slots 220, the top surface of the plate 218 is flush with the top surface of the annular step 222 so as to form a plaster support surface surrounded by the annular lip 221. The thickness of the plate 218 can be substantially the same as the thickness of the annular step 222. In some embodiments, the plate 218 is dual functional as it also redirects the flow of water through the stem toward the circular opening 216 on the stem.

Figure 32:
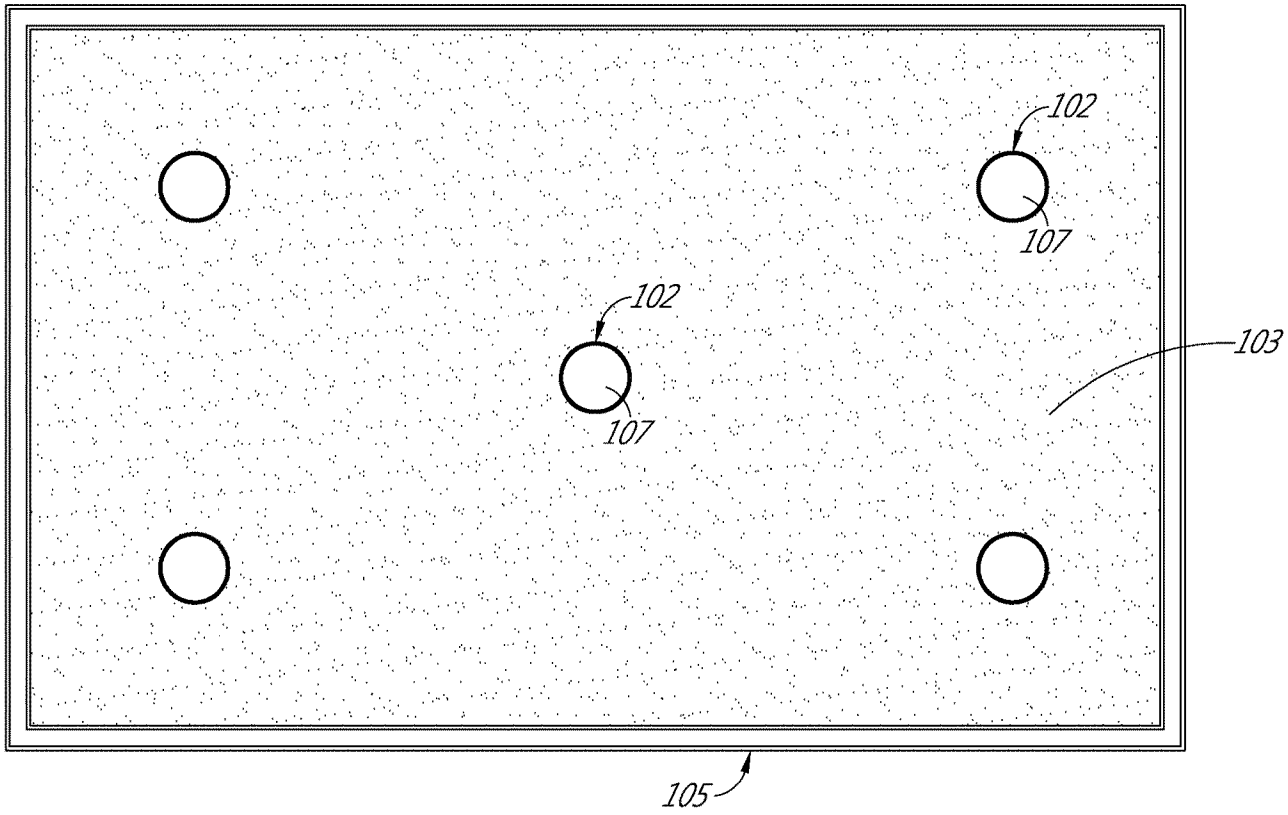
FIG. 32 illustrates one or more waterjet apparatuses installed as part of an in-floor cleaning system for a pool or spa.

FIG. 32 illustrates one or more waterjet apparatuses 102 positioned in a surface finish 103 that can contain an artificial body water (e.g., a pool or spa 105). As discussed herein, the waterjet apparatus 102 can have plaster 107 (e.g., a surface finish) with a pattern made to match the surrounding surface 103 of, for example, the pool. The plaster 107 as discussed herein can substantially conceal one or more waterjet apparatuses 102 of, for example, a cleaning system of a pool/spa 105 such that the waterjet apparatuses 102 substantially blend into the pebble-type finish or sand-like finish 103 provided in many modern swimming pool/spa 105. For example, plaster resembling sand or pebbles can be used as part of the finish of the interior surface or wall 103 of the pool/spa 105. The finish 103 can be produced in a wide variety of colors and textures. In some implementations, the waterjet apparatus according to the present disclosure can also be used in shower or bath systems where waterjet nozzles are mounted on the walls for cleaning purposes.

It is contemplated that various combinations or subcombinations of the specific features and aspects of the embodiments disclosed above may be made and still fall within one or more of the inventions. Further, the disclosure herein of any particular feature, aspect, method, property, characteristic, quality, attribute, element, or the like in connection with an embodiment can be used in all other embodiments set forth herein. Accordingly, it should be understood that various features and aspects of the disclosed embodiments can be combined with or substituted for one another in order to form varying modes of the disclosed inventions. Thus, it is intended that the scope of the present inventions herein disclosed should not be limited by the particular disclosed embodiments described above. Moreover, while the inventions are susceptible to various modifications, and alternative forms, specific examples thereof have been shown in the drawings and are herein described in detail. It should be understood, however, that the inventions are not to be limited to the particular forms or methods disclosed, but to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. For example, actions such as "passing a suspension line through the base of the tongue" include "instructing the passing of a suspension line through the base of the tongue." It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. The ranges disclosed herein also encompass any and all overlap, sub-ranges, and combinations thereof. Language such as "up to," "at least," "greater than," "less than," "between," and the like includes the number recited. Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of, within less than 5% of, within less than 1% of, within less than 0.1% of, and within less than 0.01% of the stated amount. Features of embodiments disclosed herein preceded by a term such as "approximately", "about", and "substantially" as used herein represent the feature with some variability that still performs a desired function or achieves a desired result for that feature.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

Although the present subject matter has been described herein in terms of certain embodiments, and certain exemplary methods, it is to be understood that the scope of the subject matter is not to be limited thereby. Instead, the Applicant intends that variations on the methods and materials disclosed herein which are apparent to those of skill in the art will fall within the scope of the disclosed subject matter.

What is claimed is:

1. A waterjet apparatus for cleaning an artificial body of water, the waterjet apparatus comprising:

a housing comprising a housing periphery about a central axis of the housing and a plurality of engagement cutouts at the housing periphery at least partially forming the housing periphery, the housing periphery defining an outermost boundary of the housing;

a head movably connected to the housing, the head configured to reciprocate correspondingly with an intermittent delivery of pressurized water and configured to direct the pressurized water along a desired direction to clean the artificial body of water, wherein the head rotates about the central axis of the housing with each intermittent delivery of pressurized water; and a plaster attachment device connected to the head, the plaster attachment device comprising a plaster attachment device periphery about the central axis, the plaster attachment device periphery substantially aligned with the housing periphery along the central axis, and the plaster attachment device comprising a plaster opening, a sidewall, and a cutout at the plaster attachment device periphery at least partially forming the plaster attachment device periphery, the plaster opening configured to receive and support plaster mixtures substantially matching plaster mixtures of a wall configured to contain the artificial body of water, the plaster opening configured to support plaster at a desired depth, the sidewall configured to support plaster at a desired radius, and the cutout configured to mate with a maintenance tool, wherein an engagement cutout of the plurality of engagement cutouts aligns with the cutout of the plaster attachment device when pressurized water is not being delivered to the head such that the maintenance tool is capable of passing through the cutout of the plaster attachment device to engage the engagement cutout of the housing at the outermost boundary of the housing.

2. The apparatus of claim 1, wherein the plaster attachment device comprises a flange extending into the plaster opening, the flange configured to maintain the plaster in the plaster opening.

3. The apparatus of claim 1, further comprising a sleeve configured to be positioned in the wall configured to contain the artificial body of water, the sleeve engaging the housing to position the housing in a predetermined position relative to the sleeve, wherein an uppermost surface of the sleeve is below an uppermost surface of the plaster attachment device along the central axis.

4. The apparatus of claim 3, further comprising a riser ring configured to be positioned at least partially within the sleeve, the riser ring circumscribing the plaster attachment device about the central axis when pressurized water is not being delivered to the head, wherein an uppermost surface of the riser ring is substantially flush with the uppermost surface of the plaster attachment device when pressurized water is not being delivered to the head.

5. The apparatus of claim 1, further comprising a sleeve configured to be positioned in the wall configured to contain the artificial body of water, the sleeve engaging the housing to position the housing in a predetermined position relative to the sleeve, wherein an uppermost surface of the sleeve is substantially flush with an uppermost surface of the plaster attachment device when pressurized water is not being delivered to the head.

6. The apparatus of claim 1, wherein the plaster opening has a depth along the central axis of about ⅛ inches to about 1 inch.

7. The apparatus of claim 1, wherein the plaster mixtures comprise plaster and pebbles.

8. The apparatus of claim 1, wherein the plaster attachment device comprises a supporting wall extending radially outward from the central axis, the supporting wall configured to support plaster in the plaster opening.

9. The apparatus of claim 8, wherein the supporting wall and the sidewall are substantially perpendicular such that at least a part of the sidewall extends substantially along and about the central axis.

10. The apparatus of claim 8, wherein the supporting wall is substantially flat from the central axis leading to the sidewall.

11. The apparatus of claim 1, wherein the plaster attachment device comprises a flange extending into the plaster opening, the flange configured to maintain plaster in the plaster opening, and wherein the flange extends toward the central axis from the cutout of the plaster attachment device.

12. The apparatus of claim 1, wherein the sidewall comprises an indentation in the sidewall in the plaster opening toward the central axis to accommodate the cutout at the plaster attachment device periphery while maintaining a desired thickness of the sidewall at the cutout.

13. The apparatus of claim 1, further comprising a recessed base configured to be positioned within the plaster attachment device to cover a central opening in the plaster attachment device, the central opening being within the plaster opening and in fluid communication with the head such that the recessed base at least partially directs the pressurized water along the desired direction.

14. The apparatus of claim 13, wherein the plaster attachment device comprises a lip in the central opening, the lip configured to position the recessed base in the central opening, the lip comprising a cutout, and wherein the recessed base comprises a projection configured to engage the cutout of the lip to secure the recessed base within the plaster attachment device.

15. The apparatus of claim 1, further comprising a cap configured to cover the plaster opening, and the cap comprising a projection configured to engage the cutout of the plaster attachment device to secure the cap to the plaster attachment device.

16. A waterjet apparatus for cleaning an artificial body of water, the waterjet apparatus comprising:

a housing comprising a housing periphery about a central axis of the housing, the housing periphery defining an outermost boundary of the housing;

a head movably connected to the housing, the head configured to reciprocate correspondingly with an intermittent delivery of pressurized water and configured to direct the pressurized water along a desired direction to clean the artificial body of water, wherein the head rotates about the central axis of the housing with each intermittent delivery of pressurized water; and a plaster attachment device connected to the head, the plaster attachment device comprising a plaster attachment device periphery about the central axis, the plaster attachment device periphery substantially aligned with the housing periphery along the central axis, and the plaster attachment device comprising a plaster opening, a sidewall, and wherein at least one of the housing or the plaster attachment device comprise an engagement cutout being positioned radially about the plaster attachment device periphery and configured to mate with a maintenance tool when pressurized water is not being delivered to the head, the plaster opening configured to receive and support plaster mixtures substantially matching plaster mixtures of a wall configured to contain the artificial body of water, the plaster opening configured to support plaster at a desired depth, the sidewall configured to support plaster at a desired radius, and wherein the maintenance tool is capable of engaging the engagement cutout to rotate the housing about the central axis via the maintenance tool mating with the engagement cutout when pressurized water is not being delivered to the head.

17. The apparatus of claim 16, wherein the sidewall of the plaster attachment device comprises an indentation into the plaster opening toward the central axis to accommodate the engagement cutout at the plaster attachment device periphery while maintaining a desired thickness of the sidewall at the engagement cutout, and wherein the plaster attachment device comprises a flange extending into the plaster opening, the flange configured to maintain plaster in the plaster opening, and wherein the flange extends toward the central axis from the engagement cutout, and wherein the flange extends beyond the indentation of the sidewall.

18. The apparatus of claim 16, further comprising a cap configured to cover at least one of the plaster opening or at least a portion of the housing, wherein the cap comprises a projection configured to engage at least one of the plaster attachment device or the housing to secure the cap to the apparatus.

19. The apparatus of claim 18, wherein at least one of the plaster attachment device or the housing comprises a cap cutout, and wherein the projection of the cap is configured to engage the cap cutout to secure the cap to the apparatus.

20. A waterjet apparatus for cleaning an artificial body of water, the waterjet apparatus comprising:

a housing comprising a housing periphery about a central axis of the housing, the housing periphery defining an outermost boundary of the housing, wherein the housing periphery comprising a cutout;

a head movably connected to the housing, the head configured to reciprocate correspondingly with an intermittent delivery of pressurized water and configured to direct the pressurized water along a desired direction to clean the artificial body of water, wherein the head rotates about the central axis of the housing with each intermittent delivery of pressurized water; and a plaster attachment device connected to the head, the plaster attachment device comprising a plaster attachment device periphery about the central axis, the plaster attachment device periphery substantially aligned with the housing periphery along the central axis, and the plaster attachment device comprising a plaster opening, a sidewall positioned adjacent the cutout at the housing periphery, and a flange extending into the plaster opening, the plaster opening configured to receive and support plaster mixtures substantially matching plaster mixtures of a wall configured to contain the artificial body of water, the plaster opening configured to support plaster at a desired depth, the sidewall configured to support plaster at a desired radius, and the flange extending inwardly from the plaster attachment device periphery to at least partially form the plaster attachment device periphery and the flange extending into the plaster opening to maintain the plaster in the plaster opening, wherein the cutout is configured to mate with a maintenance tool capable of rotating the housing about the central axis via engagement of at least one of a protrusion or the cutout on the housing when pressurized water is not being delivered to the head.

* * * * *